US006762567B2

(12) United States Patent
Ide

(10) Patent No.: US 6,762,567 B2
(45) Date of Patent: Jul. 13, 2004

(54) DRIVING DEVICE FOR PLASMA DISPLAY PANEL

(75) Inventor: Shigeo Ide, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 0 days.

(21) Appl. No.: 10/303,709

(22) Filed: Nov. 26, 2002

(65) Prior Publication Data

US 2003/0122494 A1 Jul. 3, 2003

(30) Foreign Application Priority Data

Dec. 3, 2001 (JP) ..... 2001-368665
Dec. 10, 2001 (JP) ..... 2001-375190
Jan. 18, 2002 (JP) ..... 2002-009485

(51) Int. Cl.[7] ..... G09G 3/10

(52) U.S. Cl. ..... 315/169.4; 315/169.2; 345/60

(58) Field of Search ..... 315/169.4, 169.1, 315/169.2; 313/400, 500, 505; 345/41, 42, 55, 60; G09G 3/10

(56) References Cited

U.S. PATENT DOCUMENTS 6,459,212 B2 * 10/2002 Tokunaga et al. ..... 315/169.4

6,630,796 B2 * 10/2003 Tokunaga et al. ..... 315/169.4

* cited by examiner

*Primary Examiner*—Don Wong
*Assistant Examiner*—Trinh Vo Dinh
(74) *Attorney, Agent, or Firm*—Sughrue Mion, PLLC

(57) ABSTRACT

The present invention provides a plasma display driving device capable of enhancing contrast by adjusting in accordance with the ambient illuminance of a plasma display panel the level change rate at the leading edge portion of a resetting pulse for causing the occurrence of a resetting discharge, which initializes all the discharge cells of the plasma display panel. The present invention also provides a plasma display panel driving method for enabling power consumption to be held in check by changing the number of sustaining pulses per unit time to be applied to each discharge cell in an emission sustaining step in accordance with the ambient illuminance of the plasma display panel, and, in addition, by adjusting the pulse width of at the least one of the above-mentioned sustaining pulse and scanning pulse for pixel data writing. The present invention also provides a plasma display panel driving device that enables power consumption to be held in check by determining a frequency of application of a displaying pulse to be applied per unit time based on the average brightness of an input image and the illuminance around a PDP, and by applying displaying pulses to each discharge cell in accordance with the frequency of the application.

8 Claims, 25 Drawing Sheets

FIG. 12

(SELECTIVE ERASING)

| GLAYSCALE LEVELS | DATA CONVERSION TABLE OF DATA CONVERTING CIRCUIT 32 | | | | | | | | | EMISSION DRIVING PATTERN | | | | | | | | VISIBLE BRIGHTNESS | | | |
|---|---|---|---|---|---|---|---|---|---|---|---|---|---|---|---|---|---|---|---|---|---|
| | PDs | GD | | | | | | | | SF 1 | SF 2 | SF 3 | SF 4 | SF 5 | SF 6 | SF 7 | SF 8 | MODE 1 | MODE 2 | MODE 3 | MODE 4 |
| | | 1 | 2 | 3 | 4 | 5 | 6 | 7 | 8 | | | | | | | | | | | | |
| 1 | 0000 | 1 | 0 | 0 | 0 | 0 | 0 | 0 | 0 | ● | | | | | | | | 0 | 0 | 0 | 0 |
| 2 | 0001 | 0 | 1 | 0 | 0 | 0 | 0 | 0 | 0 | ○ | ● | | | | | | | 1 | 2 | 3 | 4 |
| 3 | 0010 | 0 | 0 | 1 | 0 | 0 | 0 | 0 | 0 | ○ | ○ | ● | | | | | | 7 | 14 | 21 | 28 |
| 4 | 0011 | 0 | 0 | 0 | 1 | 0 | 0 | 0 | 0 | ○ | ○ | ○ | ● | | | | | 23 | 46 | 69 | 92 |
| 5 | 0100 | 0 | 0 | 0 | 0 | 1 | 0 | 0 | 0 | ○ | ○ | ○ | ○ | ● | | | | 47 | 94 | 141 | 188 |
| 6 | 0101 | 0 | 0 | 0 | 0 | 0 | 1 | 0 | 0 | ○ | ○ | ○ | ○ | ○ | ● | | | 82 | 164 | 246 | 328 |
| 7 | 0110 | 0 | 0 | 0 | 0 | 0 | 0 | 1 | 0 | ○ | ○ | ○ | ○ | ○ | ○ | ● | | 128 | 256 | 384 | 512 |
| 8 | 0111 | 0 | 0 | 0 | 0 | 0 | 0 | 0 | 1 | ○ | ○ | ○ | ○ | ○ | ○ | ○ | ● | 185 | 370 | 555 | 740 |
| 9 | 1000 | 0 | 0 | 0 | 0 | 0 | 0 | 0 | 0 | ○ | ○ | ○ | ○ | ○ | ○ | ○ | ○ | 255 | 510 | 765 | 1020 |

BLACK CIRCLE : SUSTAIN DISCHARGE EMISSION
WHITE CIRCLE : SELECTIVE ERASE DISCHARGE

FIG. 18

| LC \ SF | SF1 | SF2 | SF3 | SF4 | SF5 | SF6 | SF7 | SF8 |
|---|---|---|---|---|---|---|---|---|
| MODE 1 | 1 | 6 | 16 | 24 | 35 | 46 | 57 | 70 |
| MODE 2 | 2 | 12 | 32 | 48 | 70 | 92 | 114 | 140 |
| MODE 3 | 3 | 18 | 48 | 72 | 105 | 138 | 171 | 210 |
| MODE 4 | 4 | 24 | 64 | 96 | 140 | 184 | 228 | 280 |

LOW

SCREEN BRIGHTNESS

HIGH

FIG.20

(SELECTIVE ERASING)

| GLAYSCALE LEVELS | DATA CONVERSION TABLE OF DATA CONVERTING CIRCUIT 32 | | | | | | | | | EMISSION DRIVING PATTERN | | | | | | | | VISIBLE BRIGHTNESS RATIO |
|---|---|---|---|---|---|---|---|---|---|---|---|---|---|---|---|---|---|---|
| | PDs | GD | | | | | | | | SF 1 | SF 2 | SF 3 | SF 4 | SF 5 | SF 6 | SF 7 | SF 8 | |
| | | 1 | 2 | 3 | 4 | 5 | 6 | 7 | 8 | | | | | | | | | |
| 1 | 0000 | 1 | 0 | 0 | 0 | 0 | 0 | 0 | 0 | ● | | | | | | | | 0 |
| 2 | 0001 | 0 | 1 | 0 | 0 | 0 | 0 | 0 | 0 | ○ | ● | | | | | | | 1 |
| 3 | 0010 | 0 | 0 | 1 | 0 | 0 | 0 | 0 | 0 | ○ | ○ | ● | | | | | | 7 |
| 4 | 0011 | 0 | 0 | 0 | 1 | 0 | 0 | 0 | 0 | ○ | ○ | ○ | ● | | | | | 23 |
| 5 | 0100 | 0 | 0 | 0 | 0 | 1 | 0 | 0 | 0 | ○ | ○ | ○ | ○ | ● | | | | 47 |
| 6 | 0101 | 0 | 0 | 0 | 0 | 0 | 1 | 0 | 0 | ○ | ○ | ○ | ○ | ○ | ● | | | 82 |
| 7 | 0110 | 0 | 0 | 0 | 0 | 0 | 0 | 1 | 0 | ○ | ○ | ○ | ○ | ○ | ○ | ● | | 128 |
| 8 | 0111 | 0 | 0 | 0 | 0 | 0 | 0 | 0 | 1 | ○ | ○ | ○ | ○ | ○ | ○ | ○ | ● | 185 |
| 9 | 1000 | 0 | 0 | 0 | 0 | 0 | 0 | 0 | 0 | ○ | ○ | ○ | ○ | ○ | ○ | ○ | ○ | 255 |

BLACK CIRCLE : SUSTAIN DISCHARGE EMISSION
WHITE CIRCLE : SELECTIVE ERASE DISCHARGE

FIG.23

AVERAGE BRIGHTNESS LEVEL OF PICTURE "40"

| AMBIENT ILLUMINANCE OF PDP 10 | NO. OF SUSTAINING PULSES | SF1 | SF2 | SF3 | SF4 | SF5 | SF6 | SF7 | SF8 |
|---|---|---|---|---|---|---|---|---|---|
| LOW | 510 | 2 | 12 | 32 | 48 | 70 | 92 | 114 | 140 |
| INTERMIDIATE | 765 | 3 | 18 | 48 | 72 | 105 | 138 | 171 | 210 |
| HIGH | 1020 | 4 | 24 | 64 | 96 | 140 | 184 | 228 | 280 |

LOW

SCREEN BRIGHTNESS

HIGH

T1 > T2 > T3

P1 > P2 > P3
S1 > S2 > S3

DRIVING DEVICE FOR PLASMA DISPLAY PANEL

BACKGROUND OF THE INVENTION

1. Field of the Invention

The present invention relates to a driving method and a driving device for a matrix display-type plasma display panel (hereinafter referred to as PDP)

2. Description of Related Art

AC (alternating current discharge) type PDP is well known as one such matrix display-type display panel.

The AC-type PDP comprises a plurality of column electrodes, and a plurality of row electrodes, which are arranged orthogonal to these column electrodes, and which form one scanning line per pair of electrodes. These respective row electrodes and column electrodes are covered with a dielectric layer for the discharge space, and assume a structure, wherein a discharge cell, which supports a pixel, is formed at each intersecting portion of a pair of row electrodes and a column electrode.

Here, a subfield method is known as one method for implementing an intermediate brightness display for this PDP. In a subfield method, the display period of one field is displayed by being divided into N subfields, which emit light only for a time corresponding to the weighting of each bit digit of N-bits of pixel data.

When using the subfield method, if it is supposed, for example, that the pixel data being supplied is constituted by six bits, a period of one field is divided into six subfields SF1, SF2 . . . , SF6, and emission driving is performed for each subfield.

Each subfield is constituted by a simultaneous resetting step, a pixel data writing step, and an emission sustaining step. In a simultaneous resetting step, by simultaneously causing discharge excitation (reset discharging) of all the discharge cells of the above-mentioned PDP, the wall charges of all the discharge cells are uniformly erased. In the subsequent pixel data writing step, a selective write discharge corresponding to pixel data occurs in each discharge cell. In this state, a wall charge is formed inside a discharge cell in which a write discharge occurred, and this discharge cell is set to an "light-emitting cell." Conversely, since a wall charge is not formed in a discharge cell in which a write discharge did not occur, this cell becomes a "non-light-emitting cell." In an emission sustaining step, only a discharge cell, which has been set to an "light-emitting cell", is discharged repeatedly during a period of time corresponding to the weighting of each subfield. In this process, a brightness corresponding to the total discharge period implemented in the emission sustaining steps of subfields SF1 through SF6, respectively, is visible. That is, if discharge periods of ratios of 1:2:4:8:16:32 are allocated to each subfield SF1 through SF6, then an intermediate brightness of 64 grayscale levels can be represented.

However, the reset discharge, which was implemented for all discharge cells in this simultaneous resetting step, is accompanied by a relatively strong discharge, that is, an emission of light that is a high level of brightness. The problem is that, since an emission that has nothing in the least to do with pixel data is generated by the reset discharge at this time, this causes a drop in dark contrast when enjoying a darker image, especially inside a darkened room.

Furthermore, in another example, when the pixel data for each pixel based on an input picture signal, for example, is eight bits, a one field display period is divided into eight subfields, and a simultaneous resetting step, a pixel data writing step, and an emission sustaining step are executed sequentially inside each subfield.

In a simultaneous resetting step, discharge excitation (reset discharging) is caused in all the discharge cells of the above-mentioned PDP simultaneously, thereby causing wall charges to be formed inside all the discharge cells. In a pixel data writing step, a discharge occurs selectively (selective erase discharge) for each discharge cell according to the logic level of the pixel data bit corresponding to the subfield thereof. In this process, the wall charge inside a discharge cell in which a selective erase discharge occurred is erased, and this discharge cell is set to a non-light-emitting cell state. Conversely, since the wall charge inside a discharge cell in which a selective erase discharge did not occur remains unchanged, this discharge cell is set to an light-emitting cell state. In an emission sustaining step, only a discharge cell, which has been set to the above-mentioned light-emitting cell state, is repeatedly discharged (sustain discharged) during a period of time corresponding to the weighting of each subfield. In this time, a brightness corresponding to the total number of sustain discharges, which occurred in the respective emission sustaining steps of the eight subfields, is visible. In other words, if numbers of sustain discharges having the ratios of 1:2:4:8:16:32:64:128 are allocated to the eight subfields, respectively, by combining the subfields in which sustain discharges occur within a one field display period, an intermediate brightness of 256 ($=2^8$) grayscale levels can be represented.

In driving a PDP in this way, a plurality of discharge cells are subjected to repeated sustain discharges in the emission sustaining steps of the respective subfields to achieve a display of intermediate brightness corresponding to input picture signals. Consequently, the problem is that, since current is applied to the respective discharge cells each time this sustain discharge occurs, a lot of power is consumed.

Furthermore, when a picture signal, which represents a high brightness picture, is supplied, the problem is that, since the number of sustain discharges occurring per unit time to realize this high brightness picture display increases, the power consumption increases in accordance with this.

SUMMARY OF THE INVENTION

An object of the present invention is to provide a plasma display driving device, which is capable of enhancing contrast.

A driving device of a plasma display panel according to a first aspect of the present invention is a plasma display panel driving device for driving, in accordance with picture signals, a plasma display panel, in which a plurality of discharge cells supporting display pixels are arranged in a matrix, having resetting means for generating a reset step for causing the occurrence of a reset discharge, which initializes each of the above-mentioned discharge cells to one of either an light-emitting cell state or a non-light-emitting cell state, and applies this to each of the above-mentioned discharge cells; pixel data writing means for applying to the respective above-mentioned discharge cells a scanning pulse for causing the occurrence of a selective discharge, which selectively sets the above-mentioned discharge cells to either the above-mentioned non-light-emitting cell state or the above-mentioned emission-cell state in accordance with pixel data corresponding to the above-mentioned picture signals; emission sustaining means for applying to each of the above-mentioned discharge cells a sustaining pulse for causing the occurrence of a sustain discharge, which causes light to be emitted repeatedly only from the above-mentioned discharge cells that are in the above-mentioned light-emitting cell state; a light sensor for detecting the ambient illuminance of the above-mentioned plasma display panel; and reset step waveform adjusting means for adjusting the level change rate at the leading edge portion of the above-mentioned resetting step in accordance with the above-mentioned illuminance.

Furthermore, a driving device of a plasma display panel according to a second aspect of the present invention is a plasma display panel driving device for driving, in accordance with picture signals, a plasma display panel, in which a plurality of discharge cells supporting display pixels are arranged in a matrix, having resetting means for generating a reset step for causing the occurrence of a reset discharge, which initializes each of the above-mentioned discharge cells to one of either an light-emitting cell state or a non-light-emitting cell state, and applies this to each of the above-mentioned discharge cells; pixel data writing means for applying to each of the above-mentioned discharge cells a scanning pulse for causing the occurrence of a selective discharge, which selectively sets the above-mentioned discharge cells to either the above-mentioned non-light-emitting cell state or the above-mentioned emission-cell state in accordance with pixel data corresponding to the above-mentioned picture signals; emission sustaining means for applying to each of the above-mentioned discharge cells a sustaining pulse for causing the occurrence of a sustain discharge, which causes repeated light emissions only in the above-mentioned discharge cells that are in the above-mentioned light-emitting cell state; and a light sensor for detecting the ambient illuminance of the above-mentioned plasma display panel, and the above-mentioned resetting means changes the number of times, which the above-mentioned resetting step is applied to each of the above-mentioned discharge cells in accordance with the above-mentioned illuminance.

Another object of the present invention is to provide a plasma display panel driving method and driving device, which are capable of holding down power consumption.

A driving method of a plasma display panel according to a third aspect of the present invention is a plasma display panel driving method for driving, in accordance with picture signals, a plasma display panel, in which a plurality of discharge cells supporting display pixels are arranged in a matrix, comprising a pixel data writing step for applying to each of the above-mentioned discharge cells a scanning pulse for causing the occurrence of selective discharge, which selectively sets the above-mentioned discharge cells to either the above-mentioned non-emission state or the above-mentioned emission state in accordance with the pixel data of each of the above-mentioned display pixels corresponding to the above-mentioned picture signals; an emission sustaining step for repeatedly applying to each of the above-mentioned discharge cells a sustaining pulse for causing a sustain discharge only in the above-mentioned discharge cells that are in the above-mentioned light-emitting cell state; and an adjusting step for changing the number of the above-mentioned sustaining pulses per unit time applied to each of the above-mentioned discharge cells in the above-mentioned emission sustaining step in accordance with the ambient illuminance of the above-mentioned plasma display panel, and, in addition, for adjusting the pulse width of at the least one of the above-mentioned scanning pulse and the above-mentioned sustaining pulse.

Furthermore, a driving device of a plasma display panel according to a third aspect of the present invention is a plasma display panel driving device for driving, in accordance with picture signals, a plasma display panel, in which a plurality of discharge cells supporting display pixels are arranged in a matrix, having pixel data writing means for applying to each of the above-mentioned discharge cells a scanning pulse for causing the occurrence of a selective discharge, which selectively sets the above-mentioned discharge cells to either the above-mentioned non-light-emitting cell state or the above-mentioned emission-cell state in accordance with the pixel data of each of the above-mentioned display pixels corresponding to the above-mentioned picture signals; emission sustaining means for repeatedly applying to each of the above-mentioned discharge cells a sustaining pulse for causing a sustain discharge only in the above-mentioned discharge cells that are in the above-mentioned light-emitting cell state; an external light sensor for detecting illuminance surrounding the above-mentioned plasma display panel; and adjusting means for changing the number of the above-mentioned sustaining pulses per unit time applied to each of the above-mentioned discharge cells in accordance with the above-mentioned illuminance, and, in addition, for adjusting the pulse width of at the least one of the above-mentioned scanning pulse and the above-mentioned sustaining pulse.

A driving method of a plasma display panel according to a fourth aspect of the present invention is a plasma display panel driving method for carrying out a display corresponding to input picture signals by causing discharge to occur by repeatedly applying displaying pulses to each of the above-mentioned discharge cells of a plasma display panel comprising a plurality of discharge cells supporting display pixels, having an average brightness computing step for computing the average brightness of an image displayed in accordance with the above-mentioned input picture signals; an illuminance detecting step for detecting the ambient illuminance of the above-mentioned plasma display panel; and a driving step for computing the application frequency at which the above-mentioned displaying pulse is to be applied using a conversion function, which has the above-mentioned average brightness and above-mentioned illuminance as parameters, and applying to each of the above-mentioned discharge cells the above-mentioned displaying pulse in accordance with the above-mentioned application frequency.

Furthermore, a driving device of a plasma display panel according to a fourth aspect of the present invention is a plasma display panel driving device for carrying out a display corresponding to input picture signals by causing discharge to occur by repeatedly applying displaying pulses to each of the above-mentioned discharge cells of a plasma display panel comprising a plurality of discharge cells supporting display pixels, having average brightness computing means for computing the average brightness of an image displayed in accordance with the above-mentioned input picture signals; illuminance detecting means for detecting the ambient illuminance of the above-mentioned plasma display panel; and driving means for computing the application frequency at which the above-mentioned displaying pulse is to be applied using a conversion function, which has the above-mentioned average brightness and above-mentioned illuminance as parameters, and applying to each of the above-mentioned discharge cells the above-mentioned displaying pulse in accordance with the above-mentioned application frequency.

BRIEF DESCRIPTION OF THE DRAWINGS

FIG. 12 is a diagram respectively showing a data conversion table of data converting circuit 32, emission driving pattern, and the visible brightness of each brightness mode 1 through 4;

FIG. 18 is a diagram showing the number of times a sustaining pulse IP is applied in an emission sustaining step Ic for each subfield by brightness mode 1 through 4;

FIG. 20 is a diagram showing the data conversion table of data converting circuit 32, and an emission drive pattern;

FIG. 23 is a diagram showing the number of sustaining pulses to be applied within the display period of one field and the number of applications inside each subfield by the ambient illuminance of PDP 10 when the average brightness level of an inputted image is "40";

DESCRIPTION OF THE PREFERRED EMBODIMENTS

The embodiments of the present invention will be explained hereinafter with referrence to the accompanying drawings.

Figure 1:
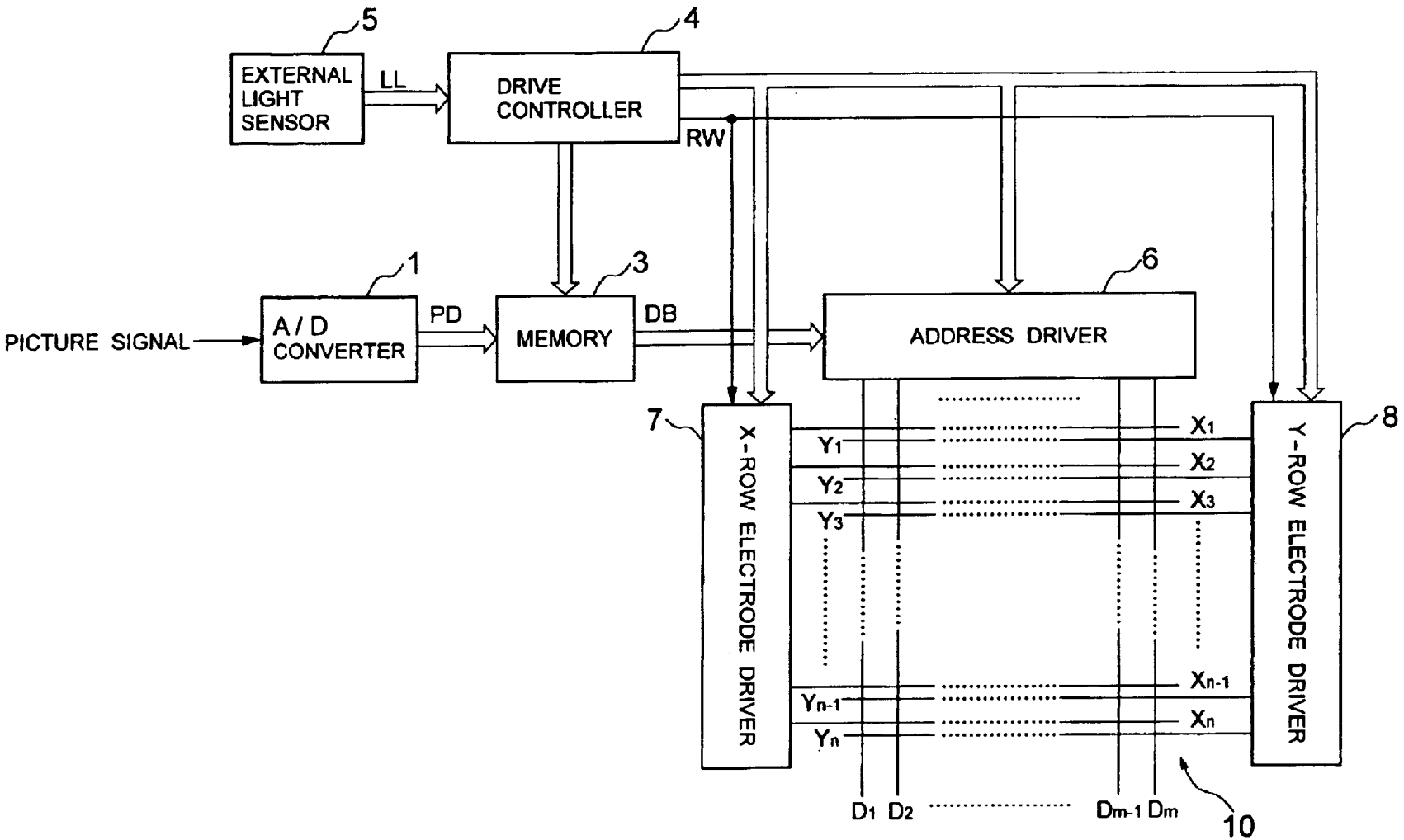
FIG. 1 is a diagram showing a plasma display apparatus equipped with a driving device for a plasma display panel according to the present invention.

FIG. 1 is a diagram showing the simplified constitution of a plasma display apparatus comprising a driving device for driving a plasma display panel (hereinafter referred to as PDP).

As shown in FIG. 1, the plasma display apparatus is constituted by PDP 10 as the plasma display panel, and a driving portion comprising various functional modules.

In FIG. 1, PDP 10 comprises m column electrodes $D_1$ through $D_m$ as address electrodes, and n row electrodes $X_1$ through $X_n$ and row electrodes $Y_1$ through $Y_n$, respectively, which are arranged so as to intersect with these respective column electrodes. These row electrodes $X_1$ through $X_n$ and row electrodes $Y_1$ through $Y_n$ support a first display line through an nth display line in PDP 10 for each pair of row electrodes $X_1$ ($1 \leqq i \leqq n$) and $Y_1$ ($1 \leqq i \leqq n$). A discharge space into which is filled a discharge gas, is formed between a column electrode D and row electrodes X and Y. The constitution is such that a discharge cell corresponding to a pixel is formed at each intersecting portion of each row electrode pair and column electrode comprising this discharge space. In other words, m discharge cells, where m is equal to the number of column electrodes D, exist on a single display line.

The driving portion is constituted by an A/D converter 1, memory 3, a drive controller 4, an external light sensor 5, an address driver 6, an X-row electrode driver 7, and a Y-row electrode driver 8.

The A/D converter 1 samples an analog input picture signal, converts this, for example, to 8-bit pixel data PD corresponding to each pixel, and supplies this to memory 3. Memory 3 sequentially writes in the above-mentioned pixel data PD in accordance with write signals supplied from the drive controller 4. Then, when a write of one screen's worth of pixel data, that is, (n×m) of pixel data from pixel data $PD_{11}$ corresponding to pixels of the first line and first column to pixel data $PD_{nm}$ corresponding to pixels of the nth line and mth column, is complete, memory 3 performs a read-out operation as follows. First, memory 3 captures the first bits of each of pixel data $PD_{11}$ through $PD_{nm}$ as pixel driving data bits $DB1_{11}$ through $DB1_{nm}$, reads these out one display line at a time in accordance with the read-out addresses supplied from the drive controller 4, and supplies them to the address driver 6. Next, memory 3 captures the second bits of each of pixel data $PD_{11}$ through $PD_{nm}$ as pixel driving data bits $DB2_{11}$ through $DB2_{nm}$, reads these out one display line at a time in accordance with the read-out addresses supplied from the drive controller 4, and supplies them to the address driver 6. Thereafter, in a similar fashion, memory 3 captures the third through the Nth bits of each of pixel data $PD_{11}$ through $PD_{nm}$ as respective pixel driving data bits DB3 through DB (N), reads these out one display line at a time for each DB, and supplies them to the address driver 6. Furthermore, memory 3 executes a read-out operation for pixel driving data bits $DB_{11}$ through $DB1_{nm}$ in subfield SF1, which will be described hereinbelow, and executes a read-out operation for pixel driving data bits $DB2_{11}$ through $DB2_{nm}$ in subfield SF2. Similarly, memory 3 executes read-out operations for $DB3_{11}$ through $DB3_{nm}$ in subfield SF3, for $DB4_{11}$ through $DB4_{nm}$ in subfield SF4, . . . , and for $DB(N)_{11}$ through $DB(N)_{nm}$ in subfield SF(N).

The external light sensor 5 detects the lightness around this PDP 10, and supplies an illuminance signal LL having a signal level corresponding to this lightness to the drive controller 4.

The drive controller 4 generates a resetting pulse waveform adjusting signal RW, which has a level that accords with the above-mentioned illuminance signal LL, and supplies same to the X-row electrode driver 7 and the Y-row electrode driver 8.

Figure 2:
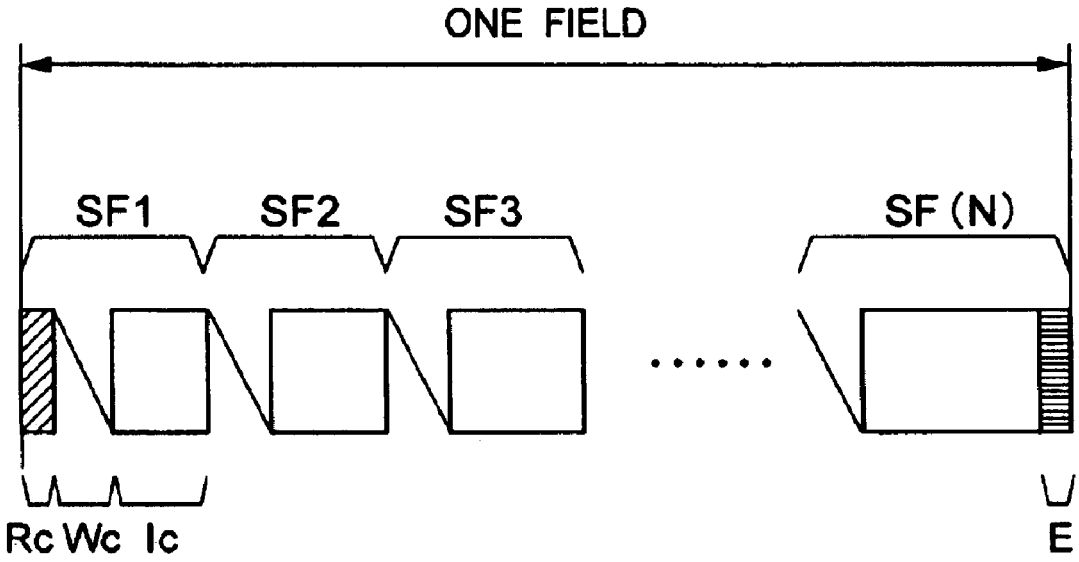
FIG. 2 is a diagram showing an example of an emission driving format, which is used in the plasma display apparatus shown in FIG. 1.

In addition, the drive controller 4 supplies various switching signals to the address driver 6, the X-row electrode driver 7, and the Y-row electrode driver 8, respectively, for driving PDP 10 to display imanges with grayscale levels in accordance with an emission driving format based on the subfield method as shown in FIG. 2.

Furthermore, in the emission driving format shown in FIG. 2, the display period of one field is divided into N subfields SF1 through SF(N), and inside each subfield, a pixel data writing step Wc and emission sustaining step Ic, respectively, are executed as described hereinabove. Also, a simultaneous resetting step Rc is executed only at the front of lead subfield SF1, and an erasing step for erasing the wall charge remaining inside each discharge cell is executed only at the very end of final subfield SF(N).

The X-row electrode driver 7 and the Y-row electrode driver 8 each generate various driving pulses in accordance with the various switching signals supplied from the above-mentioned drive controller 4, and apply these driving pulses to PDP 10 row electrodes X and Y.

Figure 3:
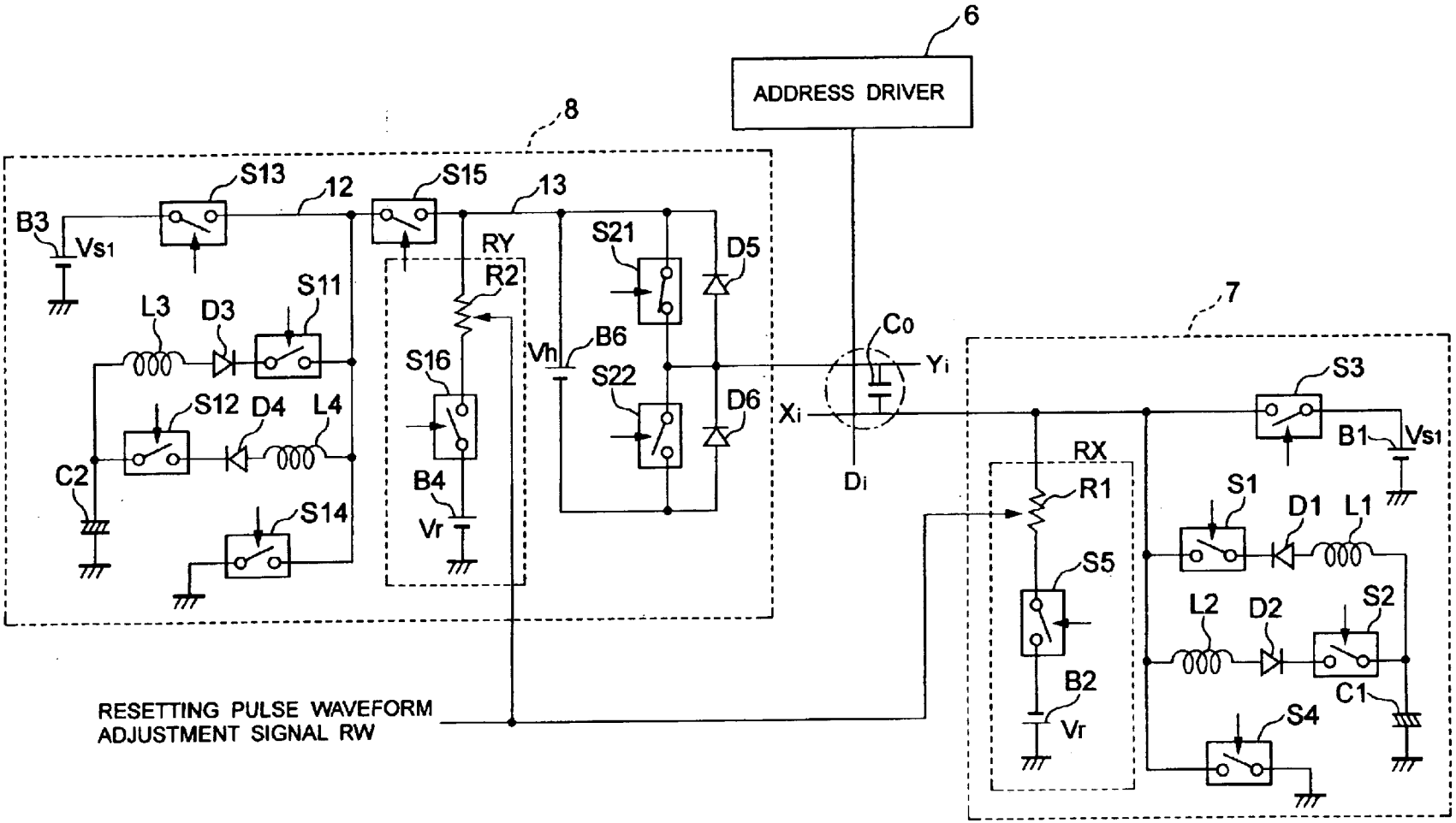
FIG. 3 is a diagram showing the internal constitution of an X-row electrode driver 7 and a Y-row electrode driver 8.

FIG. 3 is a diagram showing the internal constitutions of The X-row electrode driver 7 and the Y-row electrode driver 8, respectively.

As shown in FIG. 3, The X-row electrode driver 7 comprises a power source B1 for generating a direct current voltage $V_{S1}$, which constitutes the source of pulse voltage for a driving pulse. The positive terminal of power source B1 is connected to row electrode X of PDP 10 via a switching element S3, and the negative terminal thereof is grounded. A switching element S4 selectively grounds row electrode X. One end of a condenser C1 is grounded, and a first serial circuit comprising a coil L1, a diode D1 and a switching element S1, and a second serial circuit comprising a coil L2, a diode D2 and a switching element S2 are connected in parallel between the other end of condenser C1 and row electrode X.

In addition, The X-row electrode driver 7 is equipped with a resetting pulse generator RX comprising a variable resistor R1, a switching element S5 and a power source B2. Power source B2 generates a direct current voltage $V_r$ for carrying the pulse voltage of a resetting pulse $RP_X$, which will be described hereinbelow. The positive terminal of power source B2 is grounded, and the negative terminal is connected to the switching element S5. The switching element S5 applies a negative direct current voltage $-V_r$ generated by the negative terminal of power source B2 to row electrode X of PDP 10 via variable resistor R1 only while it is set to the ON state. Furthermore, variable resistor R1 is set to a resistance value in accordance with the resetting pulse waveform adjusting signal RW supplied from the above-mentioned drive controller 4.

Meanwhile, The Y-row electrode driver 8 comprises a power source B3 for generating a direct current voltage $V_{S1}$, which constitutes the source of pulse voltage for a driving pulse. The positive terminal of power source B3 is connected to a connection line 12 to a switching element S15 via a switching element S13, and the negative terminal thereof is grounded. Connection line 12 is grounded via the switching element S14. One end of a condenser C2 is grounded, and a first serial circuit comprising a coil L3, a diode D3 and a switching element S11, and a second serial circuit comprising a coil L4, a diode D4 and a switching element S12 are connected in parallel between the other end of condenser C2 and connection line 12. The switching element S15 makes the connection between connection line 12 and connection line 13 when it is in the ON state, and breaks the connection between these two when it is in the OFF state. The positive terminal of a power source B6, which generates a direct current voltage $V_n$ a switching element S21, and the cathode terminal of a diode D5 are connected to this connection line 13. A switching element S22 and the anode terminal of diode D6 are connected to the negative terminal of power source B6. The cathode terminal of diode D6, the anode terminals of diode D5 and the switching elements S21 and S22 are interconnected, and row electrode Y of PDP 10 is connected to the connection point thereof.

In addition, The Y-row electrode driver 8 is equipped with a resetting pulse generator RY comprising a variable resistor R2, a switching element S16 and a power source B4. Power source B4 generates a direct current voltage $V_r$ for carrying the pulse voltage of a resetting pulse $RP_Y$, which will be described hereinbelow. The negative terminal of power source B4 is grounded, and the positive terminal is connected to the switching element S16. The switching element S16 applies direct current voltage $V_r$ generated by the positive terminal of power source B4 to the above-mentioned connection line 13 via variable resistor R2 only while it is set to the ON state. Furthermore, variable resistor R2 is set to a resistance value in accordance with the resetting pulse waveform adjusting signal RW supplied from the above-mentioned drive controller 4.

Figure 4:
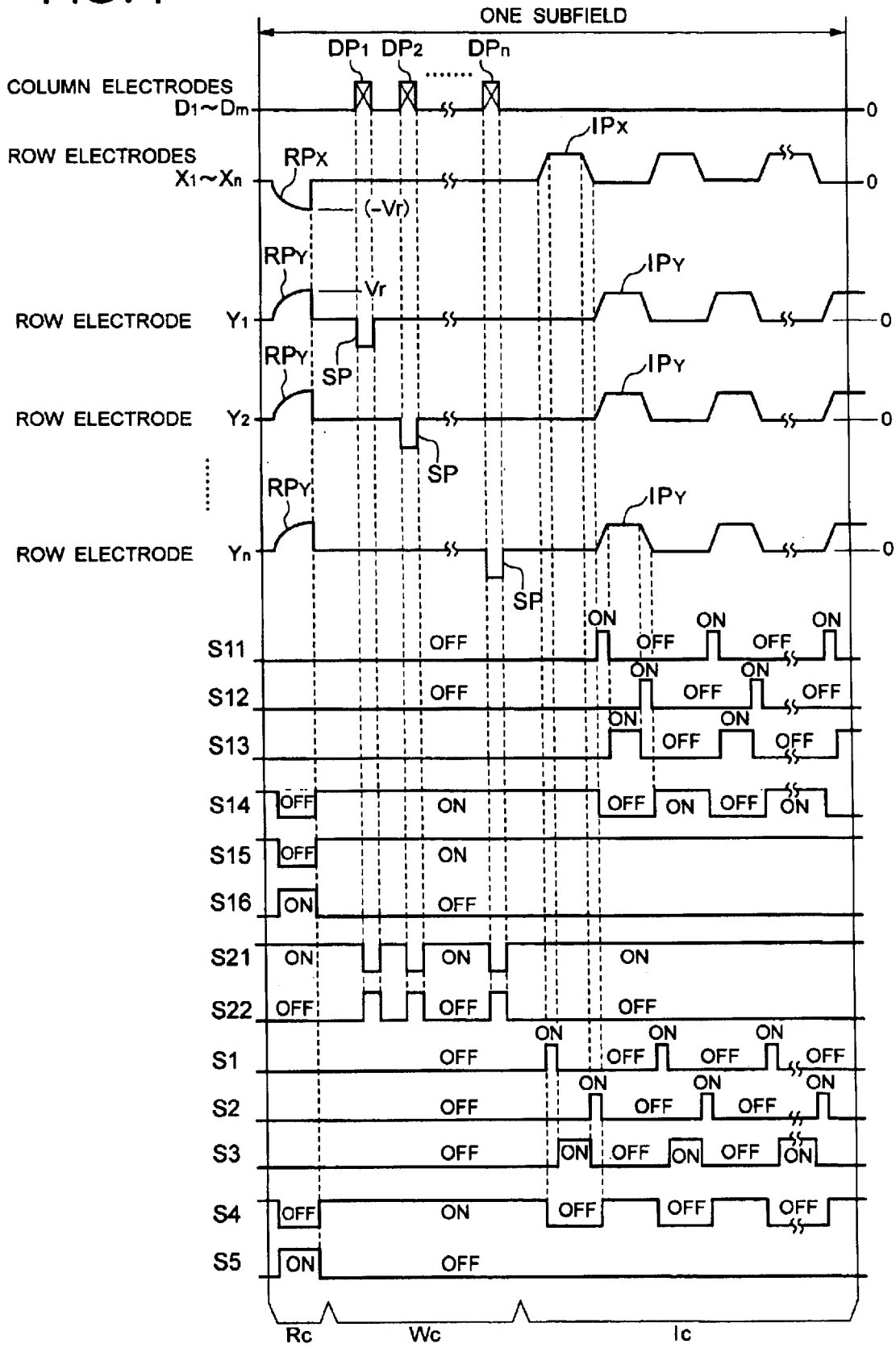
FIG. 4 is a diagram showing various driving pulses applied to a PDP 10 inside subfield SF1, and an example of the application timing thereof.

FIG. 4 is a figure showing the respective switching operations of the above-mentioned switching elements S1 through S5, S11 through S16, S21 and S22 in accordance with the various switching signals supplied from the drive controller 4, the various driving pulses generated in accordance with these switching operations, and the application timing thereof. Furthermore, in FIG. 4, only the operation inside the lead subfield SF1 in the emission driving format shown in FIG. 2 is excerpted and shown.

In FIG. 4, in the simultaneous resetting step Rc, the drive controller 4 sets the switching element S5 of The X-row electrode driver 7 and the switching elements S16 and S21 of The Y-row electrode driver 8, respectively, to the ON state, and sets other switching elements to the OFF state. By the switching element S5 of The X-row electrode driver 7 being set to the ON state, current flows into the path comprising row electrode X, variable resistor R1, the switching element S5 and power source B2. At this time, the voltage across row electrode X steadily drops at an inclination that accords with a time constant based on the load capacitance C0 between the row electrodes of PDP 10 and the resistance value of variable resistor R1. Furthermore, by the switching element S16 of The Y-row electrode driver 8 being set to the ON state, current flows into row electrode Y of PDP 10 via power source B4, the switching element S16, variable resistor R2, and the switching element S21. At this time, the voltage across row electrode Y steadily rises at an inclination that accords with a time constant based on the load capacitance C0 between the row electrodes of PDP 10 and the resistance value of variable resistor R2. Then, the drive controller 4 switches the switching element S5 to the OFF state and the switching element S4 to the ON state, respectively, at the timing at which the voltage across row electrode X reaches negative voltage $-V_r$ based on direct current voltage $V_r$ generated by power source B2. In accordance therewith, a resetting pulse $RP_X$, the level change of the leading edge (at rise time) of which reaches negative voltage $-V_r$ more slowly than the respective scanning pulse SP and sustaining pulse IP, which will be described hereinbelow, is generated. Then, this resetting pulse $RP_X$ is applied simultaneously to each of the row electrodes $X_1$ through $X_n$. In addition, the drive controller 4 switches the switching element S16 to the OFF state and the switching elements S14 and S15 to the ON state, respectively, at the timing at which the voltage across row electrode Y reaches direct current voltage $V_r$ generated by power source B4. In accordance therewith, a resetting pulse $RP_y$, the level change of the leading edge (at rise time) of which reaches positive voltage $V_r$ more slowly than the respective scanning pulse SP and sustaining pulse IP, which will be described hereinbelow, is generated. Then, this resetting pulse $RP_y$ is applied simultaneously to each of the row electrodes $Y_1$ through $Y_n$.

As described hereinabove, in accordance with the simultaneous application of the resetting pulses $RP_X$ and $RP_Y$, all the discharge cells of PDP 10 are subjected to reset discharging, and following the cessation of this discharging, a wall charge of a predetermined amount is uniformly formed and held inside each discharge cell. In accordance therewith, all discharge cells in PDP 10 are initialized to an emission (sustain discharge)—enabled state (hereinafter referred to as an light-emitting cell state) in an emission sustaining step Ic, which will be explained hereinbelow.

Next, in the pixel data writing step Wc shown in FIG. 4, the address driver 6 generates a pixel data pulse having a pulse voltage that accords with the pixel driving data bit DB1 supplied from the above-mentioned memory 3. For example, when the logic level of a pixel driving data bit DB is "1", the address driver 6 generates a high voltage, and when the logic level is "0", it generates a low voltage (0 volts). Then, the address driver 6 sequentially applies a pixel data pulse group $DP_1$, $DP_2$, . . . , $DP_n$, which groups the above-mentioned pixel data pulses by individual display line (m lines), to column electrodes $D_1$ through $D_m$. Also, in this pixel data writing step Wc, The Y-row electrode driver 8 generates a negative scanning pulse SP at the same timing as the application timing of each of the above-mentioned pixel data pulse groups $DP_1$ through $DP_n$, and sequentially applies this to row electrodes $Y_1$ through $Y_n$. Furthermore, this scanning pulse SP, as shown in FIG. 4, is generated by setting the above-mentioned the switching element S21 to the OFF state, and the switching element S22 to the ON state. In this process, a discharge (selective erase discharge) takes place only in the discharge cell at the intersecting portion of the display line to which the above-mentioned scanning pulse was applied, and the "column" to which a high voltage pixel data pulse was applied. The wall charge being held inside the discharge cell is erased by this selective erase discharge, and this discharge cell is set to a state, wherein an emission (sustain discharge) cannot be performed in an emission sustaining step Ic, which will be explained hereinbelow (hereinafter referred to as a non-light-emitting cell state). Conversely, the above-mentioned selective erase discharge does not occur in a discharge cell to which a low-voltage pixel data pulse is applied while a scanning pulse SP is being applied, and this discharge cell is maintained in the state to which it was initialized in the above-mentioned simultaneous resetting step Rc, that is, an light-emitting cell state.

According to the above-mentioned pixel data writing step Wc, each discharge cell of PDP 10 is set to either one of an light-emitting cell state or a non-light-emitting cell state in accordance with input picture signal-based pixel data.

Next, in the emission sustaining step Ic shown in FIG. 4, positive sustaining pulses $IP_X$ and $IP_y$ are generated by operating the switching elements S1 through S4 and S11 through S14 inside the X-row electrode driver 7 and the Y-row electrode driver 8, respectively, in an ON-OFF sequence like that shown in the figure. The respective The X-row electrode driver 7 and the Y-row electrode driver 8 alternately apply these positive sustaining pulses $IP_X$ and $IP_Y$ repeatedly to row electrodes X and Y. In this process, the number (or period) of sustaining pulses to be applied in each emission sustaining step Ic is set in accordance with the weighting of each subfield. Here, of all the discharge cells inside PDP 10, only the discharge cells in which the above-mentioned wall charge is formed, that is, those discharge cells that are in the light-emitting cell state, are subjected to sustain discharging each time the above-mentioned sustaining pulses $IP_X$ and $IP_Y$ are applied. In other words, only discharge cells, which have been set to the light-emitting cell state in the above-mentioned pixel data writing step Wc, repeatedly emit light pursuant to sustain discharges of only the number of times set corresponding to the weighting of the subfields thereof, and sustain this emission state.

That is, only discharge cells, which have been set to the light-emitting cell state by the pixel data writing step Wc of each subfield, emit light in the emission sustaining step IC of this subfield in proportion to a period corresponding to the weighting of this subfield. In this case, the intermediate brightness, which corresponds to the total emission period within the display period of a single field, of emitted light, which occurred in an emission sustaining step Ic of each subfield SF1 through SF(N), is visible. Furthermore, in the operations shown in FIG. 2 and FIG. 3, the only thing that can return a discharge cell to the light-emitting cell state once it has been set to the non-light-emitting cell state is a simultaneous resetting step Rc in the lead subfield SF1. Consequently, according to this driving process, the emission always occurs in an emission sustaining step IC of subfield SF1, except when representing brightness level 0, and thereafter, continuous emission occurs in the emission sustaining steps Ic of each subfield SF in proportion to a number that accords with the brightness level to be represented. That is, the brightness of the grayscale levels can be represented at the (N+1) stage according to N subfields SF1 through SF(N), including cases when brightness level 0 is represented by sustaining all subfields in a lights-out state.

Here, the reset discharge, which occurs for all discharge cells in the above-mentioned simultaneous resetting step Rc, is a relatively strong discharge, and is accompanied by an emission having a high brightness level. Since this reset discharge occurs simultaneously for all discharge cells irrespective of pixel data, it is the cause of a reduction in dark contrast.

Accordingly, in the present invention, the constitution is such that the intensity of a reset discharge is appropriately adjusted in accordance with the ambient lightness of PDP 10.

For example, when the lightness of the room in which a plasma display apparatus equipped with this PDP 10 is installed is within a predetermined range of normal illuminance, the external light sensor 5 supplies an illuminance signal LL having a signal level that accords with the lightness of this room to the drive controller 4. When this happens, the drive controller 4 supplies a resetting pulse waveform adjusting signal RW to the X-row electrode driver 7 and the Y-row electrode driver 8 for setting the level change of the leading edge of each of the resetting pulses $RP_X$ and $RP_Y$ to an inclination corresponding to the above-mentioned illuminance signal LL. In accordance therewith, variable resistors R1 and R2 respectively disposed in the resetting circuits RX and RY of the X-row electrode driver 7 and the Y-row electrode driver 8, respectively, are set to resistance values corresponding to this resetting pulse waveform adjusting signal RW. Accordingly, in this process, resetting circuits RX and RY generate the resetting pulses $RP_X$ and $RP_Y$ like those shown in FIG. 5B, in which the level change rate at the leading edge constitutes a waveform corresponding to the resetting pulse waveform adjusting signal RW.

Furthermore, when the room in which this plasma display apparatus is installed is relatively bright, the external light sensor 5 supplies to the drive controller 4 a high-level illuminance signal LL corresponding to the lightness of this room. When this happens, the drive controller 4 supplies a resetting pulse waveform adjusting signal RW to the X-row electrode driver 7 and the Y-row electrode driver 8 for setting the level change at the leading edge of each of the resetting pulses $RP_X$ and $RP_Y$ to make them slope steeply in proportion to an extent corresponding to the above-mentioned illuminance signal LL. The resistance values of variable resistors R1 and R2 inside the resetting circuits RX and RY, respectively, become small in accordance with this resetting pulse waveform adjusting signal RW, and the time constant becomes small. Accordingly, in this process, the resetting circuit RX (or RY) generates the resetting pulses $RP_X$ and $RP_Y$ of waveforms such as those shown in FIG. 5A, in which the level change rate at the leading edge is great compared to the waveform shown in FIG. 5B, that is, the time period until the waveform reaches voltage $-V_r$ (or $V_r$) is short. By simultaneously applying these resetting pulses $RP_X$ and $RP_Y$, a relatively strong reset discharge occurs in all the discharge cells.

Conversely, when the room in which this plasma display apparatus is installed is relatively dark, the external light sensor 5 supplies to the drive controller 4 a low-level illuminance signal LL corresponding to the lightness of this room. When this happens, the drive controller 4 supplies a the resetting pulse waveform adjusting signal RW to the X-row electrode driver 7 and the Y-row electrode driver 8 for setting the level change at the leading edge of each of the resetting pulses $RP_X$ and $RP_Y$ to make them slope gently in proportion to an extent corresponding to the above-mentioned illuminance signal LL. The resistance values of variable resistors R1 and R2 inside the resetting circuits RX and RY, respectively, become large in accordance with this resetting pulse waveform adjusting signal RW, and the time constant becomes large. Accordingly, at this time, the resetting circuit RX (or RY) generates the resetting pulses $RP_X$ and $RP_Y$ of waveforms such as those shown in FIG. 5C, in which the level change rate at the leading edge is small compared to the waveform shown in FIG. 5B, that is, the time period until the waveform reaches voltage $-V_r$ (or $V_r$) is long. By simultaneously applying these resetting pulses $RP_X$ and $RP_Y$, a reset discharge accompanying emission occurs in all the discharge cells, but since the intensity of this discharge is as weak as the gentleness of the level change at the leading edges of the resetting pulses $RP_X$ and $RP_Y$, the emission brightness in line with this reset discharge is also low.

In this manner, when the area around a plasma display panel is dark, making the level change rate at the leading edge of a resetting pulse small weakens the reset discharge, and reduces the emission brightness pursuant to this discharge. Accordingly, when enjoying a relatively dark image in a darkened room, the present invention enhances the dark contrast, which makes this image stand out.

Figure 5A:
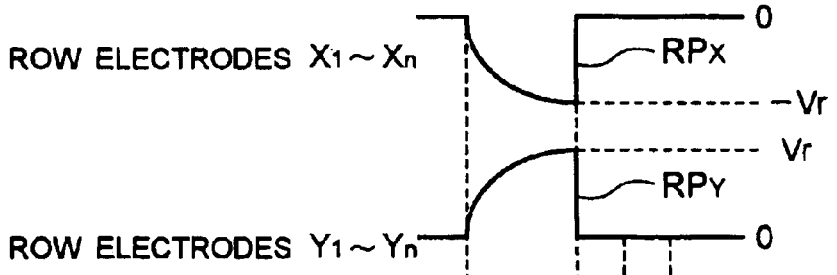
FIG. 5A through FIG. 5C are diagrams showing the resetting pulse RP waveforms of each level of lightness around a PDP.
Figure 5B:
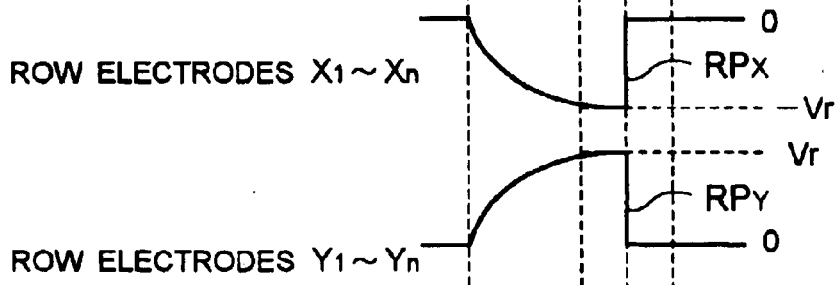
Figure 5C:
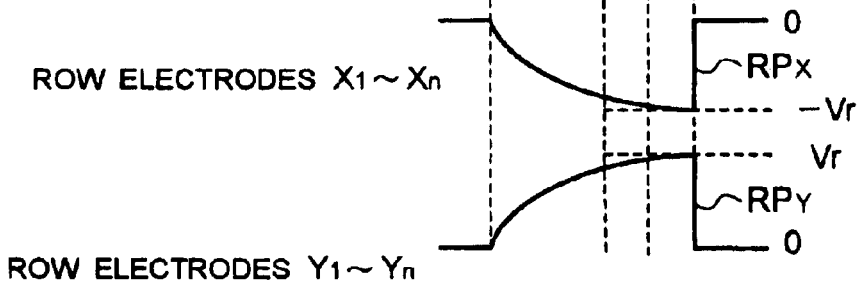

However, according to the above-mentioned driving, despite the fact that a one field display period is fixed, the pulse width of the resetting pulses $RP_X$ and $RP_Y$ changes as shown in FIG. 5A through FIG. 5C. Accordingly, the drive controller 4 changes the number of sustaining pulses $IP_X$ and $IP_Y$ to be applied in the emission sustaining step Ic of each subfield in proportion to the extent of change of the pulse widths of the resetting pulses $RP_X$ and $RP_Y$. For example, as shown in FIG. 5A, when the pulse widths of the resetting pulses $RP_X$ and $RP_Y$ are narrow, the number of sustaining pulses $IP_X$ and $IP_Y$ to be applied in the emission sustaining step Ic of each of subfields SF1 through SF(N) is increased only to that extent. Conversely, when the pulse widths of the resetting pulses $RP_X$ and $RP_Y$ are wide as shown in FIG. 5C, the number of sustaining pulses $IP_X$ and $IP_Y$ to be applied in the emission sustaining step Ic of each of subfields SF1 through SF(N) is decreased only to that extent.

That is, the drive controller 4 controls The X-row electrode driver 7 and the Y-row electrode driver 8 so as to increase the number of sustaining pulses to be applied inside each subfield when the area around a plasma display panel is relatively light, and to decrease this number of sustaining pulses when this area is dark.

Furthermore, in the above-mentioned embodiment, a case in which a so-called selective erasure addressing method, i.e. a method in which, when a wall charge is formed beforehand in each discharge cell, a pixel data write is performed by selectively erasing these wall charges in accordance with pixel data, was employed as the pixel data writing method was described.

However, the present invention can also similarly be applied to a case in which a so-called selective write addressing method, i.e. a method in which wall charges are selectively formed in accordance with pixel data, is employed as the pixel data writing method.

Figures 6A, 6B, 6C:
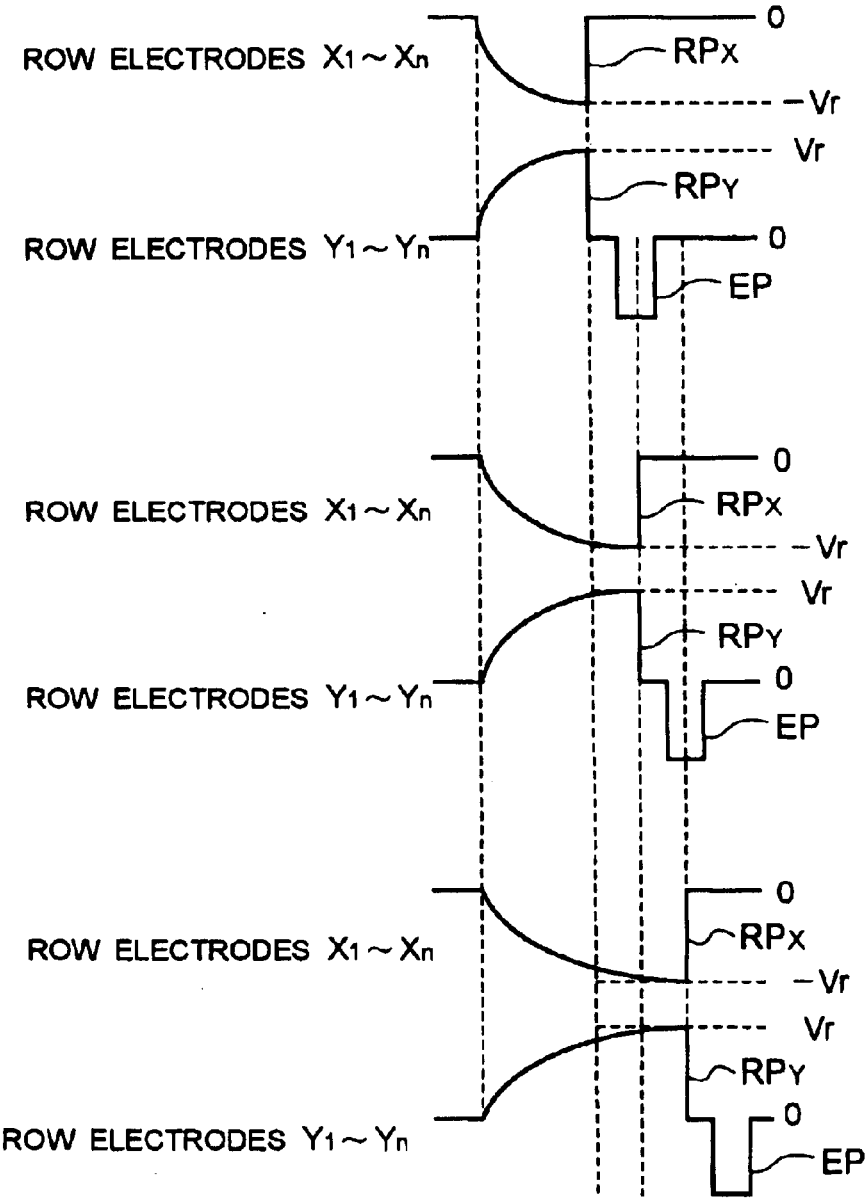
FIG. 6A through FIG. 6C are diagrams showing the resetting pulse RP waveforms of each level of lightness around a PDP when using a selective write addressing method.

When this selective write addressing method is used, immediately after applying the resetting pulse $RP_Y$ in the above-mentioned simultaneous resetting step Rc, a negative erasing pulse EP is simultaneously applied to each of row electrodes $Y_1$ through $Y_n$ as shown in FIG. 6A through FIG. 6C. Furthermore, FIG. 6A through FIG. 6C are diagrams showing the resetting pulses $RP_X$ and $RP_Y$ to be applied, the waveforms of each erasing pulse EP, and the application timing thereof when the area around PDP 10 is relatively light (FIG. 6A), when this area is within the normal illuminance range (FIG. 6B), and when this area is relatively dark (FIG. 6C), respectively.

In a simultaneous resetting step RC when using the selective write addressing method, the wall charges formed inside all the discharge cells by simultaneously applying the resetting pulses $RP_Y$ and $RP_X$ are all erased by applying the erasing pulse EP shown in FIG. 6. That is, all of the discharge cells are initialized to a non-emission state in accordance with applying this erasing pulse EP. Next, in a pixel data writing step Wc when using the selective write addressing method, discharging (a selective write discharge) only takes place in a discharge cell to which a scanning pulse SP and high-voltage pixel data pulse are simultaneously applied as described hereinabove. At this time, a wall charge is formed only inside a discharge cell in which this selective write discharge has occurred, and this discharge cell is set to the light-emitting cell state. Furthermore, since the operation in each emission sustaining step Ic when using the selective write addressing method is the same as when using the selective erasure addressing method, this explanation will be omitted. Here, when using the selective write addressing method, an erasing step E, which causes the occurrence of an erase discharge for erasing the wall charges remaining inside all the discharge cells, can be executed at the end of each subfield.

Figure 7A:
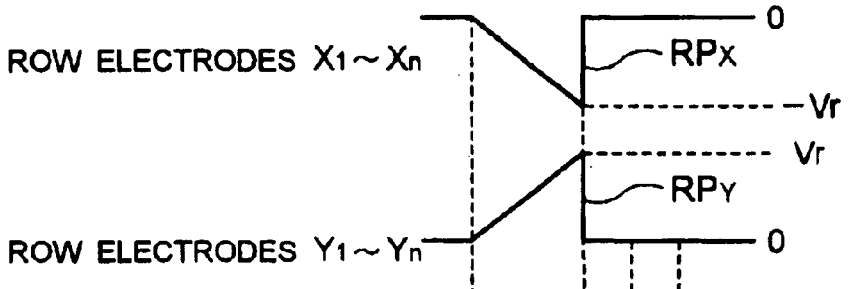
FIG. 7A through FIG. 7C are diagrams showing another example of the resetting pulse RP waveforms of each level of lightness around a PDP.
Figure 7B:
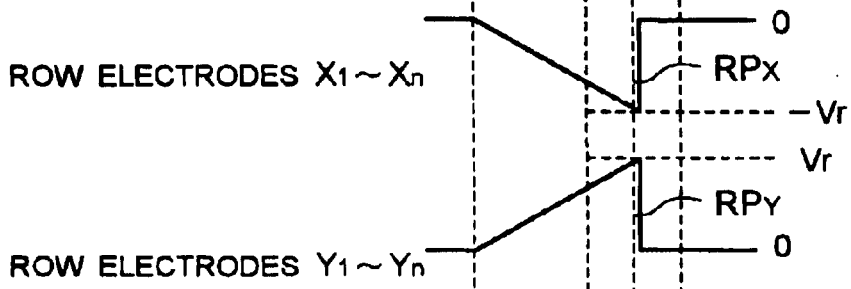
Figure 7C:
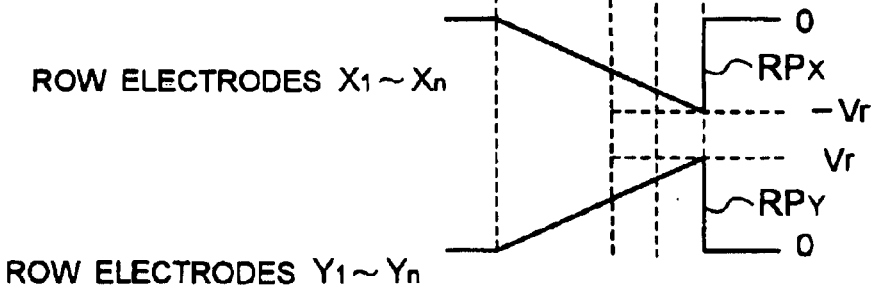

Furthermore, in the embodiment shown in FIG. 5A through FIG. 5C and FIG. 6A through FIG. 6C, the level change in the leading edge portions of the resetting pulses $RP_Y$ and $RP_X$ is a curved shape, but as in FIG. 7A through FIG. 7C, this level change can also be linear. In other words, when the area around PDP 10 is relatively bright, the level change at the leading edge portions of the resetting pulses $RP_Y$ and $RP_X$ is made steep as shown in FIG. 7A, but when this area is dark, this level change is made gentle as shown in FIG. 7C.

Furthermore, in the above-mentioned embodiment, one reset discharge should be generated within a one field display period, but the number of executions thereof can be changed in accordance with the ambient lightness of the PDP.

Figure 8A:
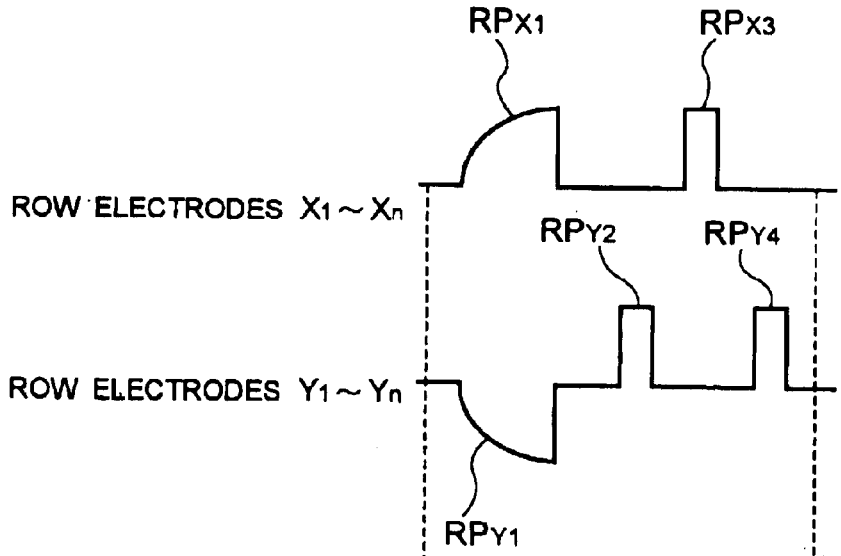
FIG. 8A and FIG. 8B are diagrams showing an example of waveforms when the number of the resetting pulses RP to be applied inside a simultaneous resetting step Rc is changed in accordance with the lightness around a PDP.
Figure 8B:
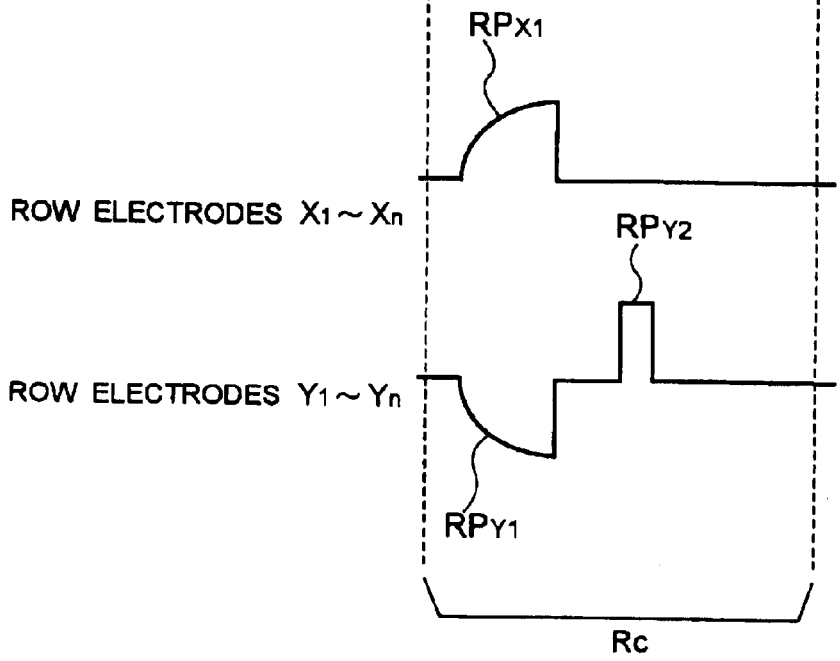

For example, when the lightness around PDP 10 is brighter than a prescribed illuminance, the number of the resetting pulses ($RP_{X1}$, $RP_{Y1}$, $RP_{Y2}$, $RP_{X3}$, $RP_{Y4}$) applied in a simultaneous resetting step Rc is set to four as shown in FIG. 8A. Conversely, when the lightness around PDP 10 is darker than a prescribed illuminance, the number of the resetting pulses ($RP_{X1}$, $RP_{Y1}$, $RP_{Y2}$) applied in a simultaneous resetting step Rc is set to two as shown in FIG. 8B. At this time, since the number of reset discharges that occur when the lightness around PDP 10 is darker than a prescribed illuminance is fewer than in the case of FIG. 8A, dark contrast is enhanced. Furthermore, the emission driving format shown in FIG. 8A through FIG. 8C presents one example of a case in which the selective write addressing method as described hereinabove is used as the pixel data writing method.

Figures 9A, 9B, 9C:
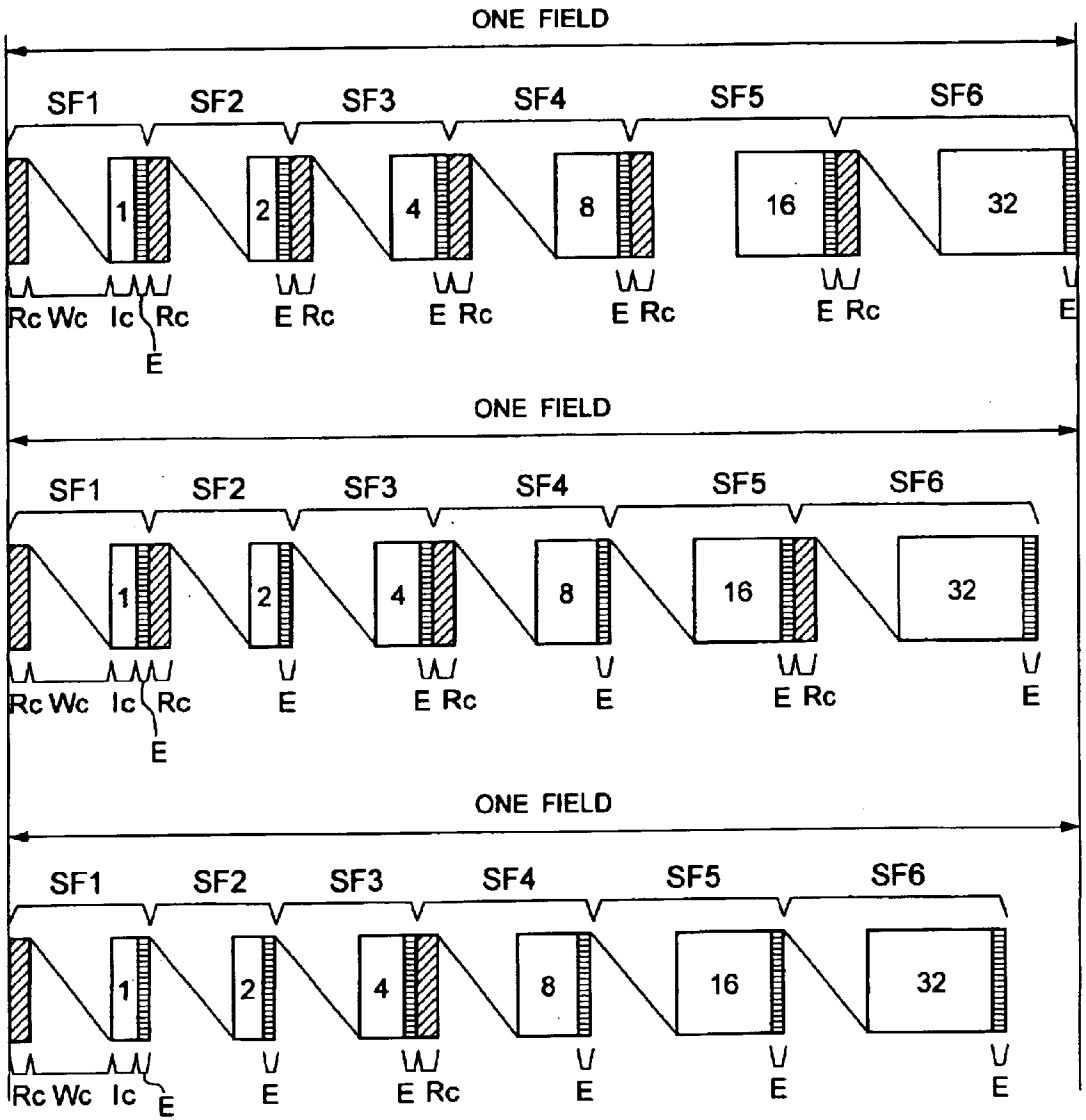
FIG. 9A through FIG. 9C are diagrams of an example of an emission driving format when the number of the simultaneous resetting steps Rc to be executed within the display period of one field is changed in accordance with the lightness around a PDP.

Or, the number of simultaneous resetting steps Rc to be executed within a one field display period can be changed in accordance with the lightness around PDP 10, for example, as shown in FIG. 9A through FIG. 9C. Furthermore, in the example shown in FIG. 9A through FIG. 9C, a one field display period is divided into six subfields comprising subfields SF1 through SF6, and the driving of the PDP 10 to display images with grayscale levels is implemented using the selective write addressing method. In this process, when the lightness around PDP 10 is brighter that a prescribed illuminance, as shown in FIG. 9A, a simultaneous resetting step Rc is executed in the respective front positions of all the subfields SF1 through SF6. Conversely, when the lightness around PDP 10 is within the predetermined range of a normal illuminance, as shown in FIG. 9B, the simultaneous resetting steps Rc are executed in the respective front positions of SF1, SF3 and SF5 of subfields SF1 through SF6, respectively. Then, when the lightness around PDP 10 is darker than a prescribed illuminance, as shown in FIG. 9C, the simultaneous resetting steps Rc are executed in the respective front positions of SF1 and SF4 of subfields SF1 through SF6, respectively. Furthermore, the waveforms of the resetting pulses $RP_X$ and $RP_Y$ generated within all the simultaneous resetting steps Rc shown in FIG. 9A through FIG. 9C, for example, are shown in FIG. 6B.

In this manner, when the PDP surroundings are dark, as shown in either FIG. 8B or FIG. 9C, reducing the number of reset discharges to occur by applying a resetting pulse weakens the emission pursuant to a reset discharge, thereby enhancing dark contrast.

As explained in detail hereinabove, in the present invention, since a reset discharge is weakened, and the emission pursuant to this discharge is weakened when the plasma display panel surroundings are dark, it is possible to enhance dark contrast when admiring a relatively dark image inside a darkened room.

Figure 10:
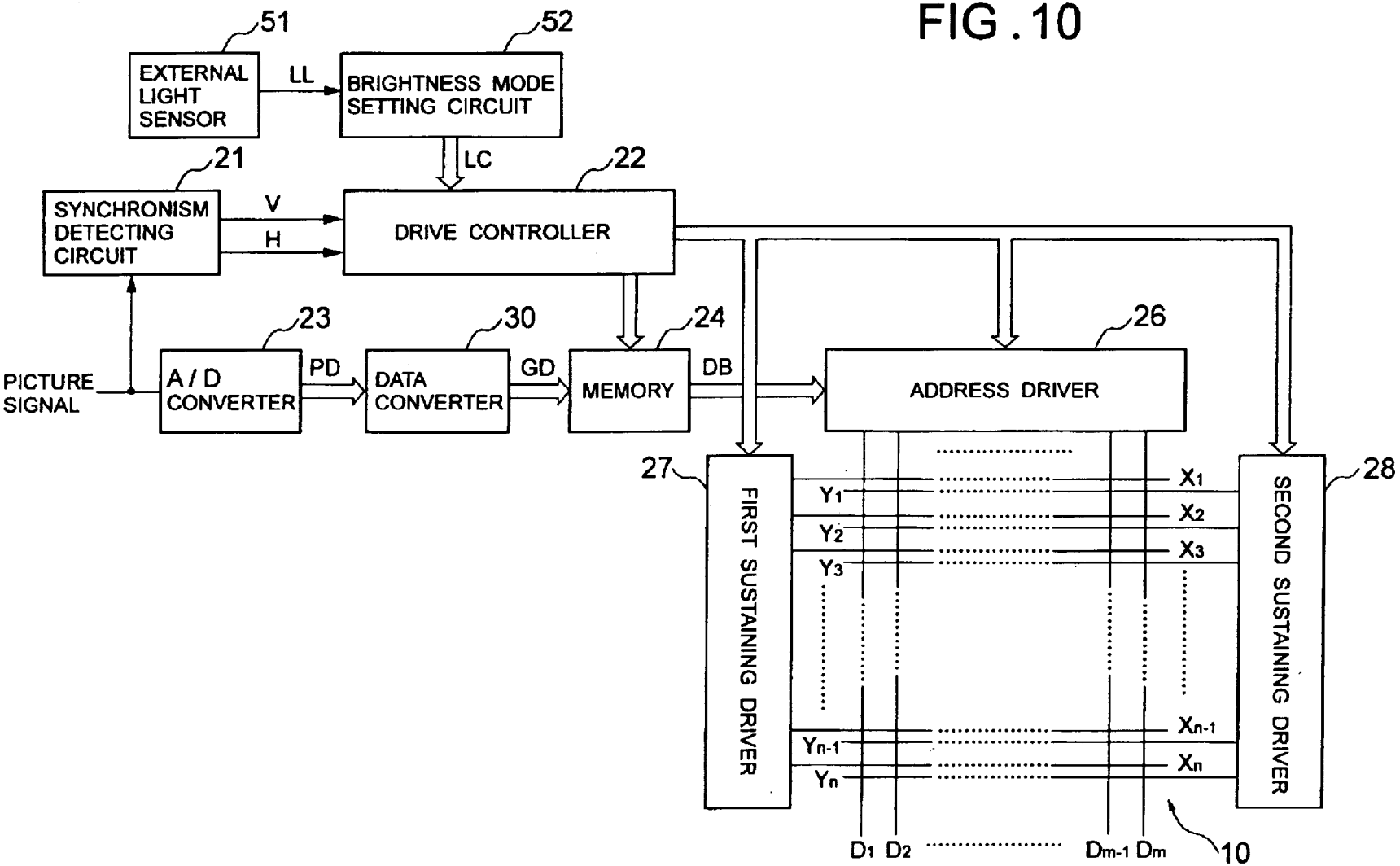
FIG. 10 is a diagram showing a plasma display apparatus for driving a plasma display panel in accordance with a driving method according to the present invention.

Another embodiment of the present invention will be explained by referring to the figures. FIG. 10 is a diagram showing the simplified constitution of a plasma display apparatus equipped with a plasma display panel (hereinafter referred to as PDP).

As shown in FIG. 10, this plasma display apparatus is constituted by the PDP 10 as a plasma display panel, and a driving portion comprising various functional modules.

The PDP 10 comprises m column electrodes $D_1$ through $D_m$ as address electrodes, and n row electrodes $X_1$ through $X_n$ and row electrodes $Y_1$ through $Y_n$, respectively, which are arranged so as to intersect with these respective column electrodes. These row electrodes $X_1$ through $X_n$ and row electrodes $Y_1$ through $Y_n$ support a first display line through an nth display line in PDP 10 for each pair of row electrodes $X_1$ ($1 \leqq i \leqq n$) and $Y_1$ ($1 \leqq i \leqq n$). A discharge space into which is filled a discharge gas, is formed between a column electrode D and row electrodes X and Y. The constitution is such that a discharge cell corresponding to a pixel is formed at each intersecting portion of each row electrode pair and column electrode comprising this discharge space. In other words, m discharge cells, that is, a number equivalent to the number of column electrodes D, exist on a single display line.

The driving portion is constituted by a synchronism detecting circuit 21, a drive controller 22, an A/D converter 23, memory 24, an address driver 26, a first sustaining driver 27, a second sustaining driver 28, a data converter 30, an external light sensor 51, and a brightness mode setting circuit 52.

Synchronism detecting circuit 21 generates a vertical synchronism detection signal V when a vertical synchronization signal is detected in an input picture signal, and generates a horizontal synchronism detection signal H when a horizontal synchronization signal is detected in an input picture signal, and supplies the same to the drive controller 22. The A/D converter 23 samples an input picture signal, converts this, for example, to 8-bit pixel data PD corresponding to each pixel, and supplies this to data converter 30. Data converter 30 performs processing for increasing shades of gradation on the pixel data, and thereafter converts this processed pixel data to 8-bit pixel driving data GD for setting each discharge cell of PDP 10 to either the light-emitting cell state or the non-light-emitting cell state, and supplies this to memory 24.

Figure 11:
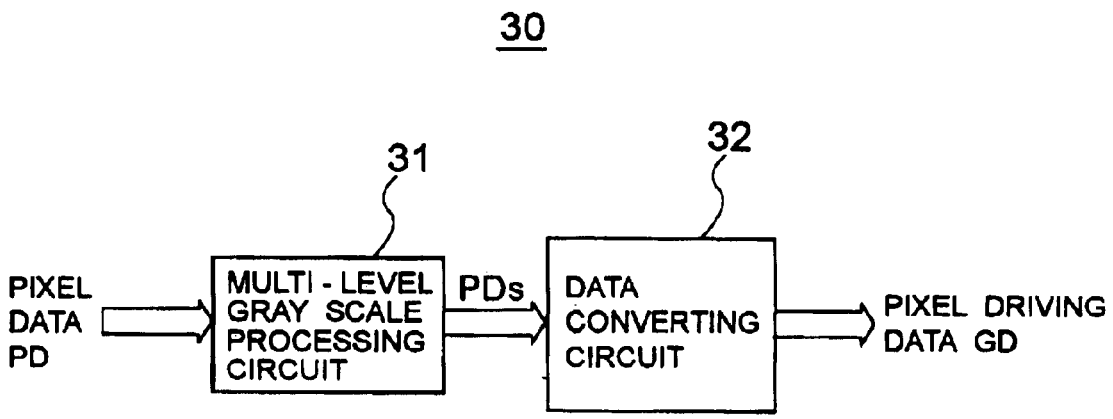
FIG. 11 is a diagram showing the internal constitution of the data converter 30 shown in FIG. 10.

FIG. 11 is a diagram showing an example of the internal constitution of this data converter 30.

In FIG. 11, a multi-level gray scale processing circuit 31 performs error diffusion processing and dithering on 8-bit pixel data. For example, in the above-mentioned error diffusion processing, first, the upper six bits of pixel data are captured as display data, and the remaining lower two bits are captured as error data. Then, the weighting of each error data of the above-mentioned pixel data PD corresponding to the respective neighboring pixels is added, and this is reflected in the above-mentioned display data. In accordance with this operation, the brightness of the lower two bits in the original pixel is falsely represented by the above-mentioned neighboring pixels, making it possible to represent the same brightness gradation as the above-mentioned 8-bit pixel data in the 6-bit display data, which is less than eight bits. Then, dithering is performed for the 6-bit error diffusion processed pixel data achieved via this error diffusion processing. In dithering, a plurality of pixels located adjacent to one another are treated as a single pixel unit, and dithering coefficients comprising mutually different coefficients are respectively allocated and added to the above-mentioned error diffusion processed pixel data corresponding to each pixel inside this single pixel unit, respectively, to achieve dithered pixel data. According to the addition of this dithering coefficient, it becomes possible to represent brightness equivalent to eight bits in just the upper four bits of the above-mentioned dithered pixel data when viewed in the above-mentioned single pixel units. Accordingly, multi-level gray scale processing circuit 31 supplies the upper four bits of the above-mentioned dithered pixel data to data converting circuit 32 as pixel data with increased shades $PD_S$.

Data converting circuit 32 converts the above-mentioned four bits of pixel data with increased shades $PD_S$ to 8-bit pixel driving data GD in accordance with a data conversion table as shown in FIG. 12, and supplies this to memory 24. Furthermore, the first through the eighth bits of pixel driving data GD, respectively, correspond to the respective subfields SF1 through SF8, which will be explained hereinbelow.

Memory 24 sequentially writes in the above-mentioned pixel driving data GD in accordance with write signals supplied from the drive controller 22. Then, when a write of one screen's worth of pixel driving data, that is, (n×m) worth of pixel driving data from pixel driving data $GD_{11}$ corresponding to pixels of the first line and first column to pixel driving data $GD_{nm}$ corresponding to pixels of the nth line and mth column, is complete, memory 24 performs a read-out operation as follows.

First, memory 3 captures the first screen's worth of written pixel driving data $GD_{11}$ through $GD_{nm}$, respectively, as pixel driving data bits DB1 through DB8, which are divided into respective bit digits (first bit through eighth bit).

That is, $DB1_{11}$ to $DB1_{nm}$: first bits of $GD_{11}$ to $GD_{nm}$, respectively $DB2_{11}$ to $DB2_{nm}$: second bits of $GD_{11}$ to $GD_{nm}$, respectively $DB3_{11}$ to $DB3_{nm}$: third bits of $GD_{11}$ to $GD_{nm}$, respectively $DB4_{11}$ to $DB4_{nm}$: fourth bits of $GD_{11}$ to $GD_{nm}$, respectively $DB5_{11}$ to $DB5_{nm}$: fifth bits of $GD_{11}$ to $GD_{nm}$, respectively $DB6_{11}$ to $DB6_{nm}$: sixth bits of $GD_{11}$to $GD_{nm}$, respectively $DB7_{11}$ to $DB7_{nm}$: seventh bits of $GD_{11}$ to $GD_{nm}$, respectively $DB8_{11}$ to $DB8_{nm}$: eighth bits of $GD_{11}$ to $GD_{nm}$, respectively Then, in the pixel data writing step Wc of subfield SF1, which will be explained hereinbelow, memory 24 reads out the above-mentioned pixel driving data bits $DB1_{11}$ through $DB1_{nm}$ one display line at a time, and supplies them to the address driver 26. Next, in the pixel data writing step Wc of subfield SF2, which will be explained hereinbelow, memory 24 reads out the above-mentioned pixel driving data bits $DB2_{11}$ through $DB2_{nm}$ one display line at a time, and supplies them to the address driver 26. Thereafter, in a similar fashion, memory 24 reads out pixel driving data bits DB3 through DB8 one display line at a time at the timing of the respective pixel data writing steps Wc of subfields SF3 through SF8, which will be explained hereinbelow, and supplies them to the address driver 26.

The external light sensor 51 is a sensor disposed in the area around the above-mentioned PDP 10, and detects the ambient lightness of PDP 10, and supplies an illuminance signal LL having a signal level corresponding to this lightness to the brightness mode setting circuit 52.

Figure 13:
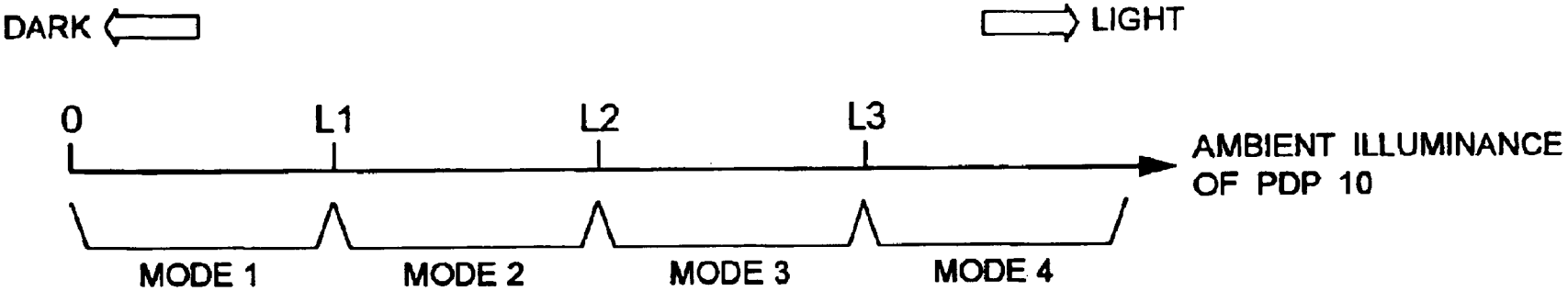
FIG. 13 is a diagram showing the corresponding relationship of the illuminance around PDP 10 and brightness modes 1 through 4.

The brightness mode setting circuit 52, as shown in FIG. 13, supplies to the drive controller 22 a brightness mode signal LC indicating brightness mode 1 when the lightness around PDP 10 represented by the above-mentioned illuminance signal LL is darker than a prescribed illuminance L1. Furthermore, brightness mode setting circuit 52 supplies to the drive controller 22 a brightness mode signal LC indicating brightness mode 2 when the lightness around PDP 10 represented by this illuminance signal LL is lighter than prescribed illuminance L1 but darker than prescribed illuminance L2. Furthermore, brightness mode setting circuit 52 supplies to the drive controller 22 a brightness mode signal LC indicating brightness mode 3 when the lightness around PDP 10 represented by this illuminance signal LL is lighter than prescribed illuminance L2 but darker than prescribed illuminance L3.

In other words, brightness mode setting circuit 52 sets four stages of brightness modes corresponding to the illuminance around PDP 10, that is, the lightness of the place in which PDP 10 is installed, in the drive controller 22.

Figure 14:
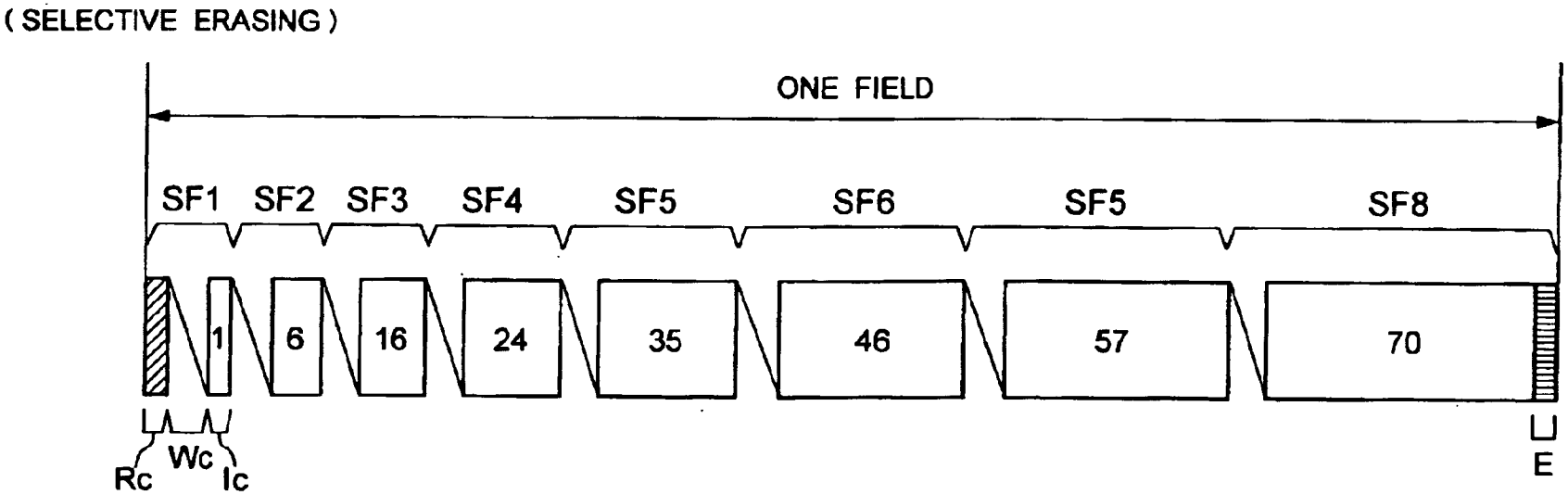
FIG. 14 is a diagram showing an example of an emission driving format used in the plasma display apparatus shown in FIG. 10.

The drive controller 22 supplies various timing signals t the address driver 26, the first sustaining driver 27 and the second sustaining driver 28 respectively, for controlling the driving of PDP 10 in accordance with the emission driving format shown in FIG. 14 and the above-mentioned brightness mode signals LC.

Furthermore, in the emission driving format shown in FIG. 14, the display period of each field (hereinafter a representation comprising a single frame as well) is divided into eight subfields SF1 through SF8. Then a pixel data writing step Wc for setting each discharge cell of PDP 10 to at the least one of either an light-emitting cell state or a non-light-emitting cell state, and an emission sustaining step Ic for causing only discharge cells, which are in the above-mentioned light-emitting cell state, to repeatedly emit light only the number of times indicated by the frequency ratio described inside FIG. 14, are implemented inside each subfield. Furthermore, a simultaneous resetting step Rc for initializing the wall charge quantity inside all the discharge cells of PDP 10 is executed only in the front of lead subfield SF1, and erasing step E for simultaneously erasing the wall charges inside all the discharge cells is executed at the very end of final subfield SF8.

Figure 15:
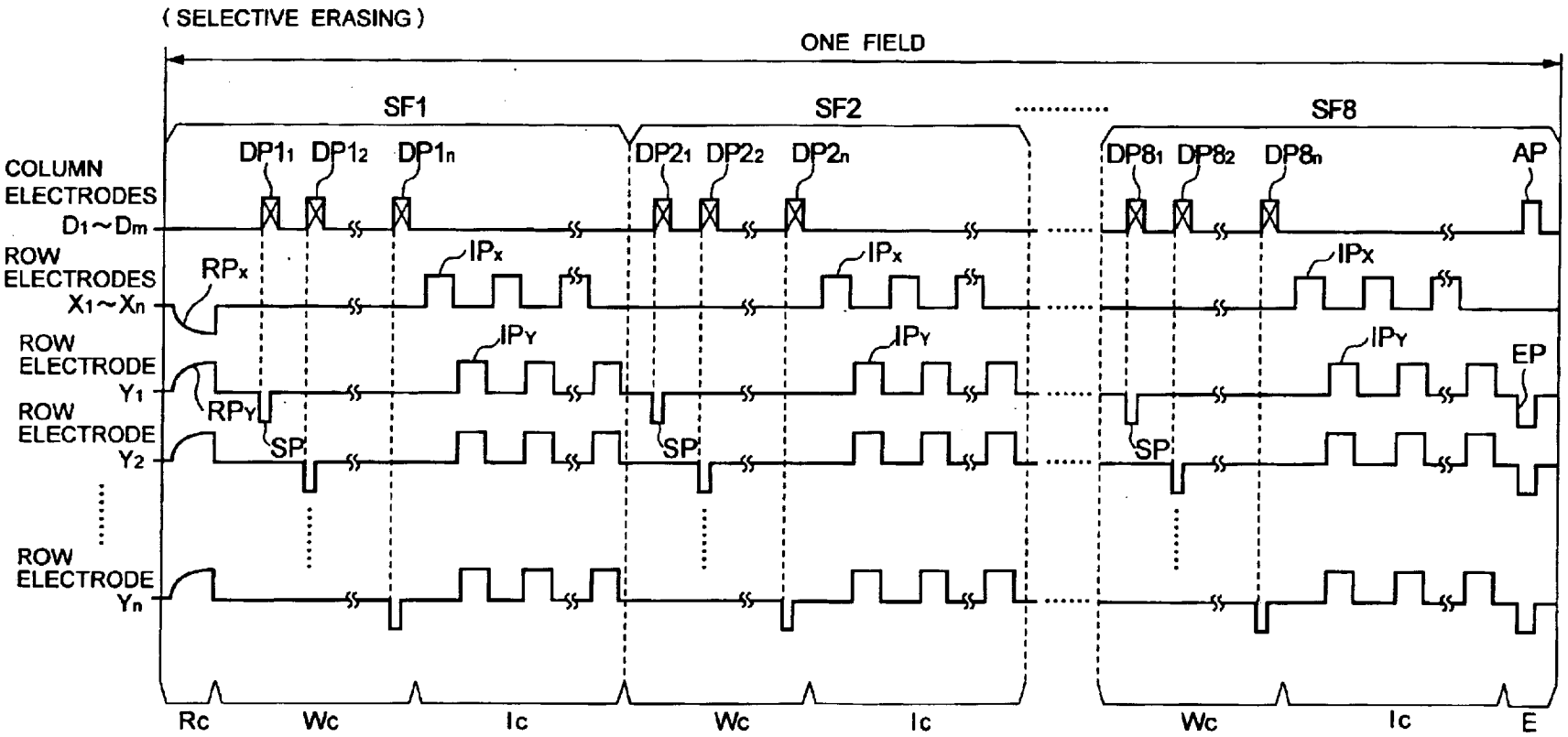
FIG. 15 is a diagram showing various driving pulses applied to PDP 10, and an example of the application timing thereof.

FIG. 15 is a diagram showing the various drive pulses, which the above-mentioned address driver 26, first sustaining driver 27 and second sustaining driver 28 apply to PDP 10, and the application timing thereof in the above-mentioned simultaneous resetting step Rc, pixel data writing step Wc, emission sustaining step Ic and erasing step E.

Firstly, in the simultaneous resetting step Rc, which is implemented only in subfield SF1, first sustaining driver 27 and second sustaining driver 28, respectively, simultaneously apply the resetting pulses $RP_X$ and $RP_Y$, which have waveforms like those shown in FIG. 15, to row electrodes $X_1$ through $X_n$ and $Y_1$ through $Y_n$. According to the simultaneous application of these resetting pulses $RP_X$ and $RP_Y$, all the discharge cells inside PDP 10 are subjected to reset discharging, and immediately after this reset discharging, a wall charge of a predetermined quantity is uniformly formed inside each discharge cell. This reset discharging initializes all the discharge cells to the light-emitting cell state.

Next, in the pixel data writing steps Wc of each subfield, the address driver 26 generates a pixel data pulse having a voltage corresponding to the logic level of the pixel driving data bit DB supplied from the above-mentioned memory 24. For example, when the logic level of a pixel driving data bit DB is "1", the address driver 26 generates a high voltage pixel data pulse, and when the logic level is "0", it generates a low voltage (0 volts) pixel data pulse. At this time, the address driver 26 applies pixel data pulses generated as described hereinabove to column electrodes $D_1$ through $D_m$ one line (m electrodes) at a time. For example, in the pixel data writing step Wc of subfield SF1, since pixel driving data bits $DB1_{11}$ through $DB1_{nm}$ are supplied from memory 24, the address driver 26 first extracts an amount corresponding to the first line, that is $DB1_{11}$ through $DB1_{1m}$, from thereamong. Then, the address driver 26 converts each of these m bits of $DB1_{11}$ through $DB1_{1m}$ to m pixel data pulses $DB1_{11}$ through $DB1_{1m}$ corresponding to the logic level thereof, and simultaneously applies these pulses to column electrodes $D_1$ through $D_m$ as shown in FIG. 15. Next, the address driver 26 extracts pixel driving data bits $DB1_{21}$ through $DB1_{2m}$ corresponding to the second line from among pixel driving data bit group $DB1_{11}$ through $DB1_{nm}$. Then, the address driver 26 converts each of these m bits of $DB1_{21}$ through $DB1_{2m}$ to m pixel data pulses $DB1_{21}$ through $DB1_{2m}$ corresponding to the logic level thereof, and simultaneously applies these pulses to column electrodes $D_1$ through $D_m$ as shown in FIG. 15. Thereafter, in the pixel data writing step Wc of subfield SF1, the address driver 26 similarly applies pixel data pulse DP1 corresponding to pixel driving data bit DB1 supplied from memory 24 to column electrodes $D_1$ through $D_m$ one line at a time.

Furthermore, in the pixel data writing step Wc, second sustaining driver 28 generates a negative scanning pulse SP as shown in FIG. 15 at the same timing as the application timing of the one-line-at-a-time pixel data pulse DP as described hereinabove, and sequentially applies this to row electrodes $Y_1$ through $Y_n$. At this time, a discharge (selective erase discharge) takes place only in the discharge cell at the intersecting portion of the row electrode to which the scanning pulse was applied, and the column electrode to which a high voltage pixel data pulse was applied, and the wall charge remaining inside the discharge cell is selectively erased. According to this selective erase discharge, discharge cells, which were initialized to the light-emitting cell state in the above-mentioned simultaneous resetting step Rc, are set to the non-light-emitting cell state. Conversely, discharge cells in which the above-mentioned selective erase discharge did not take place retain the state of immediately prior thereto. That is, discharge cells, which were in the light-emitting cell state, are set to the light-emitting cell state as-is, and discharge cells, which were in the non-light-emitting cell state, are set to the non-light-emitting cell state as-is.

Figures 16A, 16B, 16C, 16D:
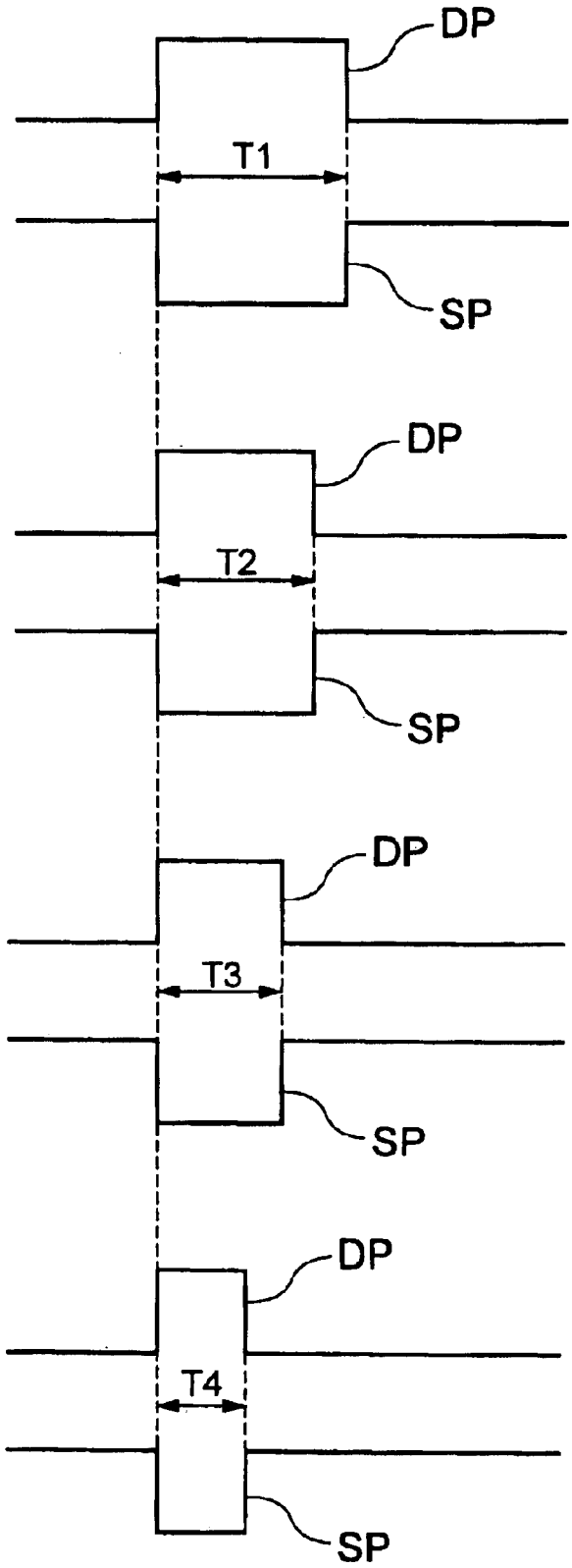
FIG. 16A through FIG. 16D are diagrams showing the pulse widths T1 through T4 of each pixel data pulse and scanning pulse SP corresponding to respective brightness modes 1 through 4.

Furthermore, in the above-mentioned pixel data writing step Wc, when the above-mentioned brightness mode signal LC indicates brightness mode 1, the address driver 26 and second sustaining driver 28 generate a pixel data pulse and a scanning pulse SP of pulse width T1 as shown in FIG. 16A. Furthermore, when the above-mentioned brightness mode signal LC indicates brightness mode 2, the address driver 26 and second sustaining driver 28 generate a pixel data pulse and a scanning pulse SP of pulse width T2, which is narrower than the above-mentioned pulse width T1, as shown in FIG. 16B. Furthermore, when the above-mentioned brightness mode signal LC indicates brightness mode 3, the address driver 26 and second sustaining driver 28 generate a pixel data pulse and a scanning pulse SP of pulse width T3, which is narrower than the above-mentioned pulse width T2, as shown in FIG. 16C. Furthermore, when the above-mentioned brightness mode signal LC indicates brightness mode 4, the address driver 26 and second sustaining driver 28 generate a pixel data pulse and a scanning pulse SP of pulse width T4, which is narrower than the above-mentioned pulse width T3, as shown in FIG. 16D.

In other words, in this pixel data writing step Wc, the address driver 26 and second sustaining driver 28 generate pixel data pulses and scanning pulses SP with wider pulse widths the darker the area around PDP 10 is. At this time, the wider the pulse width of the pixel data pulses and scanning pulses SP, the higher the discharge margin for the above-mentioned selective erase discharge. When the discharge margin becomes high, it becomes possible to reliably cause a selective erase discharge to occur, even, for example, when the priming particle weight that exists inside a discharge cell is low.

Next, in the emission sustaining step Ic of each subfield, first sustaining driver 27 and second sustaining driver 28 alternately apply positive sustaining pulses $IP_X$ and $IP_Y$ to row electrodes $X_1$ through $X_n$ and $Y_1$ through $Y_n$ as shown in FIG. 15. Here, the number of the above-mentioned sustaining pulses IP repeatedly applied in the emission sustaining step Ic of each of subfields SF1 through SF8 is based on the brightness mode indicated by the above-mentioned brightness mode signal LC.

In other words, when a brightness mode signal LC indicates brightness mode 1, the number of the above-mentioned sustaining pulses IP repeatedly applied in the emission sustaining step Ic of each of subfields SF1 through SF8 is as shown in FIG. 18, which is SF1: 1
SF2: 6
SF3: 16
SF4: 24
SF5: 35
SF6: 46
SF7: 57
SF8: 70

Furthermore, when a brightness mode signal LC indicates brightness mode 2, the number of the above-mentioned sustaining pulses IP repeatedly applied in the emission sustaining step Ic of each of subfields SF1 through SF8 is as shown in FIG. 18, which is SF1: 2
SF2: 12
SF3: 32
SF4: 48
SF5: 70
SF6: 92
SF7: 114
SF8: 140

Furthermore, when a brightness mode signal LC indicates brightness mode 3, the number of the above-mentioned sustaining pulses IP repeatedly applied in the emission sustaining step Ic of each of subfields SF1 through SF8 is as shown in FIG. 18, which is

SF1: 3

SF2: 18

SF3: 48

SF4: 72

SF5: 105

SF6: 138

SF7: 171

SF8: 210

Furthermore, when a brightness mode signal LC indicates brightness mode 4, the number of the above-mentioned sustaining pulses IP repeatedly applied in the emission sustaining step Ic of each of subfields SF1 through SF8 is as shown in FIG. 18, which is

SF1: 4

SF2: 24

SF3: 64

SF4: 96

SF5: 140

SF6: 184

SF7: 228

SF8: 280

Figure 17A:
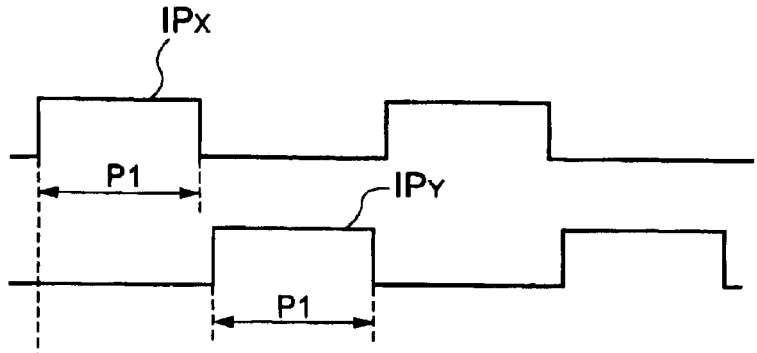
FIG. 17A through FIG. 17D are diagrams showing the pulse widths P1 through P4 of sustaining pulses IPx and IPy, respectively, corresponding to respective brightness modes 1 through 4.
Figure 17B:
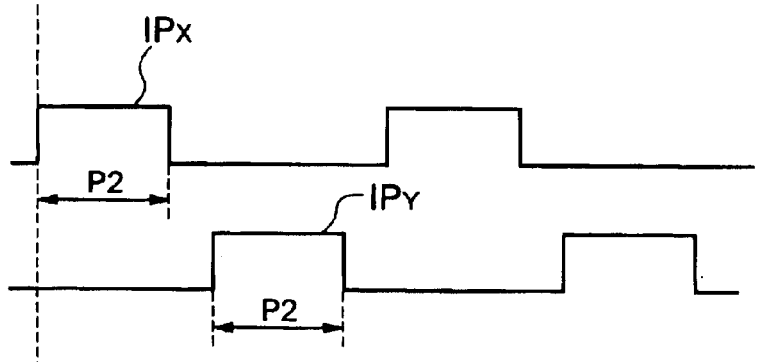
Figure 17C:
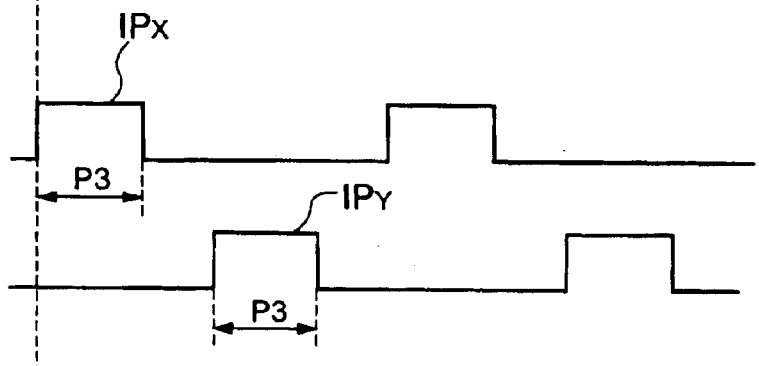
Figure 17D:
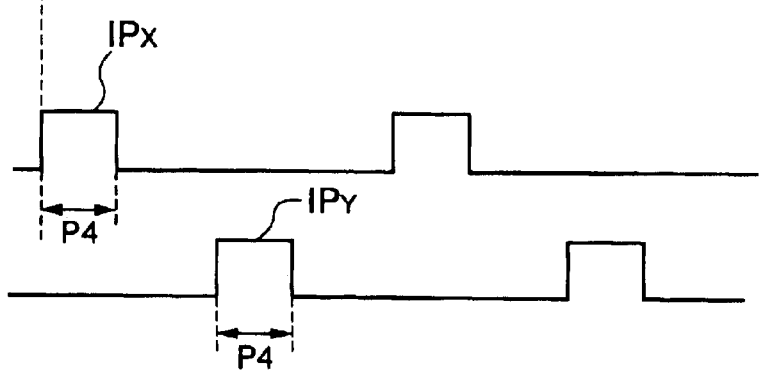
Figure 19:
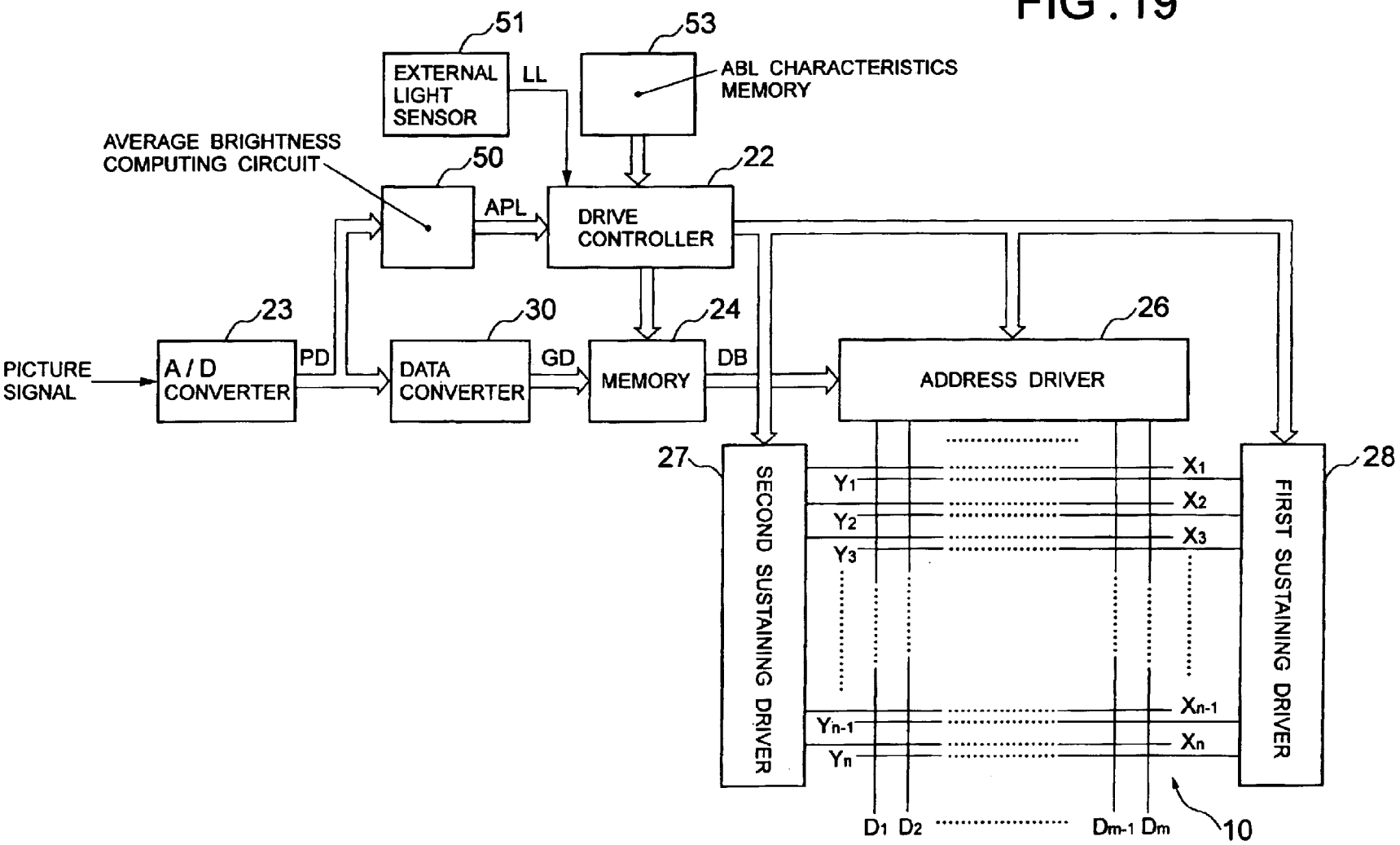
FIG. 19 is a diagram showing a plasma display apparatus for driving a plasma display panel in accordance with a driving method according to the present invention.

Furthermore, in this emission sustaining step Ic, when the above-mentioned brightness mode signal LC indicates brightness mode 1, first sustaining driver 27 and second sustaining driver 28 generate sustaining pulses $IP_X$ and $IP_Y$ of pulse width P1 as shown in FIG. 17A. Furthermore, when brightness mode signal LC indicates brightness mode 2, first sustaining driver 27 and second sustaining driver 28 generate sustaining pulses $IP_X$ and $IP_Y$ of pulse width P2, which, as shown in FIG. 17B, is narrower than the above-mentioned pulse width P1. Furthermore, when brightness mode signal LC indicates brightness mode 3, first sustaining driver 27 and second sustaining driver 28 generate sustaining pulses $IP_X$ and $IP_Y$ of pulse width P3, which, as shown in FIG. 17C, is narrower than the above-mentioned pulse width P2 . Furthermore, when brightness mode signal LC indicates brightness mode 4, first sustaining driver 27 and second sustaining driver 28 generate sustaining pulses $IP_X$ and $IP_Y$ of pulse width P4, which, as shown in FIG. 17D, is narrower than the above-mentioned pulse width P3.

In other words, in this emission sustaining step Ic, first sustaining driver 27 and second sustaining driver 28 generate sustaining pulses $IP_X$ and $IP_Y$, the pulse widths of which are wider the darker the area around PDP 10 is. At this time, the wider the pulse width of sustaining pulses $IP_X$ and $IP_Y$, the higher the discharge margin is when the above-mentioned sustain discharge occurs. When this discharge margin is high, it becomes possible to reliably cause a sustain discharge to occur, even, for example, when the priming particle weight that exists inside a discharge cell is low.

Here, only discharge cells in which the wall charge remains as-is, that is, discharge cells that were set to the light-emitting cell state in the above-mentioned pixel data writing step Wc, are subjected to a sustain discharge each time the above-mentioned sustaining pulses $IP_X$ and $IP_Y$ are applied, and the emission cell state accompanying this sustain discharge is maintained only for the number of discharges allocated for each subfield. Furthermore, as explained hereinabove, whether or not each discharge cell is set to the light-emitting cell state is determined by pixel driving data GD. At this time, the patterns capable of being adopted as the pixel driving data GD are the nine patterns shown in FIG. 12. Then, for all the patterns, with the exception of that for pixel driving data GD corresponding to multi-grayscale pixel data $PD_S$ "1000", which indicates the maximum brightness, only one bit within the first through the eighth bits becomes logic level "1" and all the other bits are logic level "0". Consequently, a selective erase discharge takes place for this bit digit in the pixel data writing step Wc of a subfield, and the discharge cell is set to the non-light-emitting cell state. Conversely, since a selective erase discharge does not take place for the respective bit digits of logic level "0" in the pixel data writing step Wc of a subfield, the discharge cell is held in the state in which it was in up until immediately prior thereto. At this time, according to the driving shown in FIG. 14, the only step that is capable of forming a wall charge inside a discharge cell, and switching this discharge cell from the non-light-emitting cell state to the light-emitting cell state is the simultaneous resetting step Rc in the lead subfield SF1. Consequently, according to driving that makes use of the pixel driving data GD of FIG. 12, a discharge cell is held in the light-emitting cell state for the period from the head of each field until a selective erase discharge occurs in the pixel data writing step Wc of the subfields marked with a black circle in FIG. 15. Then, when a selective erase discharge occurs one time, thereafter, the discharge cell is held in a non-light-emitting cell state until the very end of one field. Accordingly, each discharge cell is held in the light-emitting cell state until the first selective erase discharge takes place inside each field, and consecutive sustain discharges occur in the emission sustaining steps Ic of each subfield (indicated by white circles) that exists therebetween.

Therefore, if pixel driving data GD such as that shown in FIG. 12 is utilized, and driving, which accords with the pixel driving format shown in FIG. 14, is carried out, an intermediate brightness display of nine grayscale levels, which correspond to the total number of sustain discharge emissions that took place in each emission sustaining step Ic throughout SF1 through SF8, becomes possible.

In this process, when a brightness mode signal LC indicates brightness mode 1, a nine-gray-level intermediate brightness display having visible brightness comprising

{0, 1, 7, 23, 47, 82, 128, 185, 255} is achieved.

Furthermore, when a brightness mode signal LC indicates brightness mode 2, a nine-gray-level intermediate brightness display having visible brightness comprising

{0, 2, 14, 46, 94, 164, 256, 370, 510} is achieved.

Furthermore, when a brightness mode signal LC indicates brightness mode 3, a nine-gray-level intermediate brightness display having visible brightness comprising

{0, 3, 21, 69, 141, 246, 384, 555, 765} is achieved.

Furthermore, when a brightness mode signal LC indicates brightness mode 4, a nine-gray-level intermediate brightness display having visible brightness comprising

{0, 4, 28, 92, 188, 328, 512, 740, 1020} is achieved.

Therefore, since driving based on brightness mode 4 (or brightness mode 3) is implemented when the area around PDP 10 is light, a high-brightness image display is achieved. Conversely, since driving based on brightness mode 1 (or brightness mode 2) is implemented when the area around PDP 10 is dark, a low-brightness image display is achieved.

In other words, when enjoying an image in a dark room, since it is better if the brightness of the entire screen is low, the brightness of the overall screen is reduced by respectively decreasing the number of sustain discharges to occur in the emission sustaining step Ic of each subfield. Consequently, power consumption is reduced by the extent to which the number of sustain discharges that occur is reduced.

Here, when the frequency of occurrence of sustain discharges is reduced, the priming particle weight generated in line with these discharges is also reduced, thereby making it impossible to reliably cause various discharges (selective erase discharge, sustain discharge) to occur as described hereinabove. Accordingly, the present invention is constituted such that various discharges are made to occur reliably by reducing the number of sustain discharges that take place in the emission sustaining step of each subfield when the area around PDP 10 is dark as compared to when it is light, and, in addition, widening the respective pulse widths of scanning pulses, pixel data pulses and sustaining pulse to that extent.

Furthermore, in the above-mentioned embodiment, the respective pulse widths of scanning pulses, pixel data pulses and sustaining pulses are changed in accordance with the illuminance of the area surrounding PDP 10. However, it is also possible to adopt an arrangement that only the pulse widths of scanning pulses are changed, or only the pulse widths of the sustaining pulses are changed. In other words, it is sufficient to adopt a constitution that the pulse width of at least one of the scanning pulse or the sustaining pulse can be adjusted in accordance with the illuminance around the PDP 10.

As explained hereinabove, in the present invention, the constitution is such that the number of sustaining pulses per unit time repeatedly applied to cause the respective discharge cells to emit light is changed, and, in addition, the pulse width of at the least one of either the scanning pulse or the sustaining pulse is adjusted in accordance with the luminous intensity around the plasma display panel. Consequently, when the area around the plasma display panel is dark, if the number of sustaining pulses per unit time is reduced, and, in addition, the pulse width of at the least one of either the scanning pulse or the sustaining pulse is widened, power consumption can be reduced while also assuring reliable discharge operations.

Yet another embodiment of the present invention will be explained hereinbelow by referring to the figures.

FIG. 1 is a diagram showing the simplified constitution of a plasma display apparatus equipped with a plasma display panel (hereinafter referred to as PDP).

As shown in FIG. 1, this plasma display apparatus is constituted from PDP 10 as a plasma display panel, and a driving portion comprising various functional modules.

The driving portion is constituted from an A/D converter 23, a drive controller 22, a memory 24, an address driver 26, a first sustaining driver 27, a second sustaining driver 28, a data converter 30, an average brightness computing circuit 50, an external light sensor 51, and a memory for ABL characteristics 53.

The A/D converter 23 samples an input picture signal, converts this, for example, to 8-bit pixel data PD corresponding to each pixel, and supplies this to the data converter 30 and average brightness computing circuit 50, respectively. The data converter 30 performs the multi-level gray scale processing on pixel data PD, after which, it converts this pixel data PD to 8-bit pixel driving data GD for setting each discharge cell on the PDP 10 to either the light-emitting cell state or the non-light-emitting cell state in each subfield, and supplies this data to the memory 24.

The Data converter 30 is the same as that shown in FIG. 11, and an explanation thereof will not be reiterated.

The data converter 30 converts the above-mentioned multi-grayscale pixel data $PD_S$ of four bits to pixel driving data GD of eight bits in accordance with a data conversion table as shown in FIG. 20, and supplies this to memory 24.

Average brightness computing circuit 50 computes the average brightness level of an image according to an input picture signal based on one field's worth of the above-mentioned pixel data PD for each field (each frame), and supplies an average brightness signal APL indicating this computed average brightness level to the drive controller 22. The external light sensor 51 is a sensor disposed in the area around the above-mentioned PDP 10, and detects the ambient lightness around PDP 10, and supplies an illuminance signal LL having a signal level corresponding to this lightness to the drive controller 22.

Figure 21:
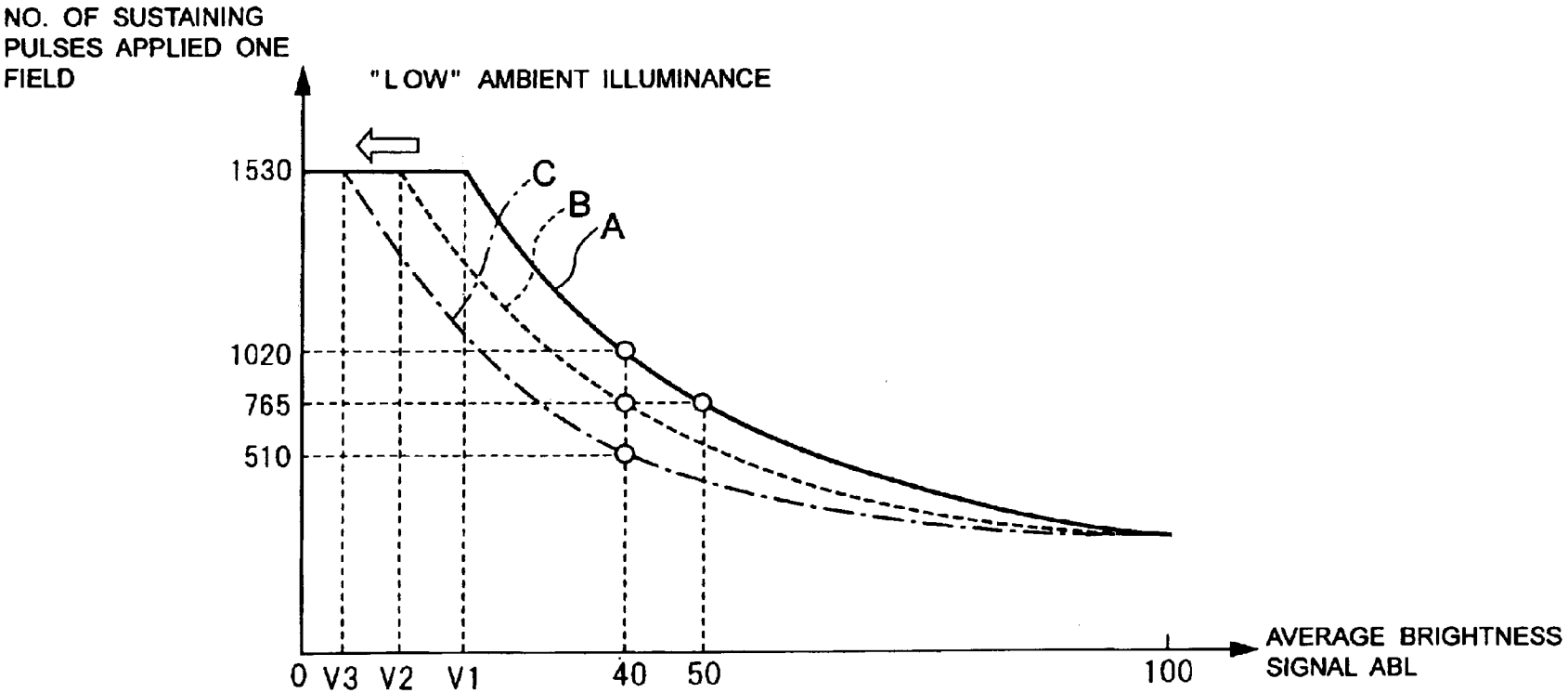
FIG. 21 is a diagram showing ABL characteristics A through C.

In The ABL (Automatic Brightness Limiting) characteristics memory 53, there is stored a data conversion table corresponding to three ABL characteristics A through C, respectively, as shown in FIG. 21, for converting the above-mentioned average brightness signal APL to a number of sustaining pulses to be applied to discharge cells inside each field, that is, an application frequency.

At this time, according to a data conversion table based on ABL characteristic A, when an average brightness signal APL is smaller than a first lower limit V1, a sustaining pulse application number of, for example, "1530" is obtained, and conversely, when an average brightness signal APL is larger than the above-mentioned first lower limit V1, an number of applications that is as small as the average brightness signal APL is large is obtained. According to this ABL characteristic A, the power consumed pursuant to a sustain discharge is held within a predetermined first power consumption regardless of the average brightness of an input picture. Furthermore, according to a data conversion table based on ABL characteristic B, when an average brightness signal APL is smaller than a second lower limit V2 (V1>V2), a sustaining pulse application number of, for example, "1530" is obtained, and conversely, when an average brightness signal APL is larger than the above-mentioned second lower limit V2, an number of applications that is as small as the average brightness signal APL is large is obtained. According to this ABL characteristic B, consumed power, which is consumed pursuant to a sustain discharge, is held within a predetermined second power consumption regardless of the average brightness of an input picture. Furthermore, according to a data conversion table based on ABL characteristic C, when an average brightness signal APL is smaller than a third lower limit V3 (V2>V3), a sustaining pulse application number of "1530" is obtained, and conversely, when an average brightness signal APL is larger than the above-mentioned third lower limit V3, an number of applications that is as small as the average brightness signal APL is large is obtained. According to this ABL characteristic C, consumed power, which is consumed pursuant to a sustain discharge, is held within a predetermined third power consumption regardless of the average brightness of an input picture.

In this manner, The ABL characteristics A through C changes the number of applications of sustaining pulses to be applied to discharge cells inside each field, that is, the application frequency, to a number that is as small as the average brightness of an input picture is high, to limit the respective power consumed pursuant to a sustain discharge to within a separately set predetermined power consumption.

Furthermore, in these ABL characteristics A through C, as for the lower limit of an average brightness signal APL, which works to limit power as explained hereinabove, as shown in FIG. 21, the above-mentioned first lower limit V1in The ABL characteristic A is the highest, followed by the second lower limit V2 in The ABL characteristic B, and the third lower limit V3 in The ABL characteristic C. Therefore, the above-mentioned second power consumption according to the above-mentioned ABL characteristic B is smaller than the above-mentioned first power consumption according to the above-mentioned ABL characteristic A, and the above-mentioned third power consumption according to the above-mentioned ABL characteristic C is smaller than the above-mentioned second power consumption.

The ABL characteristics memory 53 selectively reads out, from among The ABL characteristics A through C, a data conversion table of The ABL characteristics indicated by an ABL characteristic read-out signal supplied from the drive controller 22, and supplies this to the drive controller 22.

The drive controller 22 supplies various timing signals for driving and controlling PDP 10 in accordance with the emission driving format shown in FIG. 14, to the address driver 26, first sustaining driver 27 and second sustaining driver 28, respectively.

Next, in the emission sustaining step Ic of each subfield, the first sustaining driver 27 and second sustaining driver 28 alternately apply positive sustaining pulses $IP_X$ and $IP_Y$ to row electrodes $X_1$ through $X_n$ and $Y_1$ through $Y_n$ as shown in FIG. 15.

Here, the number of times that the above-mentioned sustaining pulses IP is repeatedly applied in the emission sustaining step Ic of each of subfields SF1 through SF8 is based on the above-mentioned average brightness signal APL, illuminance signal LL and data conversion tables read out from The ABL characteristics memory 53.

Figure 22:
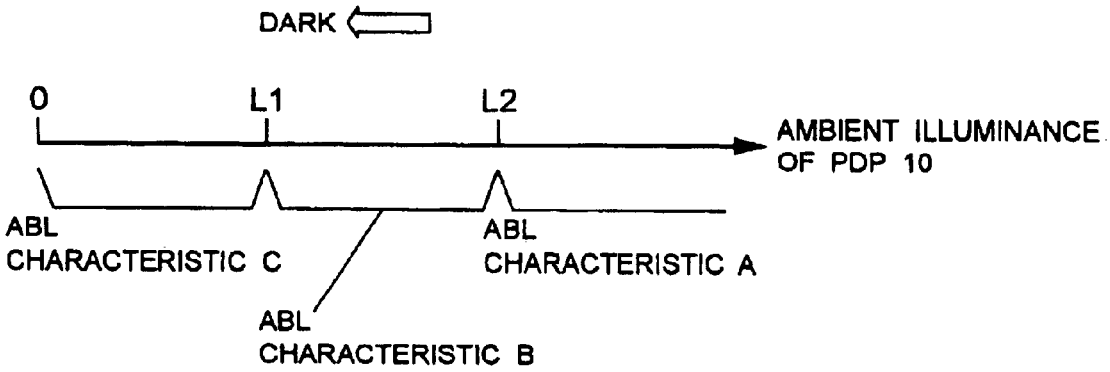
FIG. 22 is a diagram showing the corresponding relationship of the ambient illuminance of PDP 10 and ABL characteristics A through C.

For example, when the above-mentioned illuminance signal LL is lower than illuminance L1 as shown in FIG. 22, the drive controller 22 supplies an ABL characteristic read-out signal for reading out a data conversion table corresponding to the ABL characteristic C to the ABL characteristic memory 53. In accordance therewith, the ABL characteristic memory 53 supplies a data conversion table corresponding to the ABL characteristic C as shown in FIG. 21 to the drive controller 22. In this case, the drive controller 22 determines the number of applications of sustaining pulses corresponding to average brightness signal APL based on the above-mentioned data conversion table corresponding to the ABL characteristic C. Then, the drive controller 22 allocates the number of applications of sustaining pulses to be applied within this one field display period to the emission sustaining step Ic of each subfield as a frequency ratio as shown in FIG. 14, and supplies the timing signal for these sustaining pulses to the first sustaining driver 27 and the second sustaining driver 28, respectively. In accordance therewith, when the average brightness signal APL, for example, is "40" as shown in FIG. 21, according to the ABL characteristic C, "510" will be obtained as the total number of sustaining pulses to be applied inside a one field display period. Consequently, when this pulse number for sustaining pulses of "510" is allocated to the emission sustaining step Ic of the respective subfields SF1 through SF8 as a frequency ratio as shown in FIG. 14, as shown in FIG. 23, this frequency ratio becomes:

SF1: 2
SF2: 12
SF3: 32
SF4: 48
SF5: 70
SF6: 92
SF7: 114
SF8: 140

Accordingly, in the emission sustaining steps Ic of the respective subfields SF1 through SF8, the first sustaining driver 27 and second sustaining driver 28, respectively, repeatedly apply sustaining pulses $IP_X$ and $IP_Y$ to each discharge cell only the number of times described hereinabove.

Furthermore, when the above mentioned illuminance signal LL is higher than illuminance L1 but lower than illuminance L2 as shown in FIG. 22, the drive controller 22 supplies to the ABL characteristic memory 53 an ABL characteristic read-out signal for reading out a data conversion table corresponding to the ABL characteristic B. In accordance therewith, The ABL characteristic memory 53 supplies a data conversion table corresponding to the ABL characteristic B as shown in FIG. 21 to the drive controller 22. At this time, the drive controller 22 determines the number of applications of sustaining pulses corresponding to average brightness signal APL (to be applied within display period of one field) based on the above-mentioned data conversion table corresponding to the ABL characteristic B. Then, the drive controller 22 allocates the number of applications of sustaining pulses to be applied within this one field display period to the emission sustaining step Ic of each subfield as a frequency ratio as shown in FIG. 14, and supplies the timing signal for each sustaining pulse to the first sustaining driver 27 and second sustaining driver 28, respectively. According to this operation, when the average brightness signal APL, for example, is "40" as shown in FIG. 21, according to the ABL characteristic B, "765" will be obtained as the total number of sustaining pulses to be applied inside a one field display period. Consequently, when this pulse number for sustaining pulses of "765" is allocated to the emission sustaining step Ic of the respective subfields SF1 through SF8 as a frequency ratio as shown in FIG. 14, as shown in FIG. 23, this frequency ratio becomes:

SF1: 3
SF2: 18
SF3: 48
SF4: 72
SF5: 105
SF6: 138
SF7: 171
SF8: 210

Accordingly, in the emission sustaining steps Ic of the respective subfields SF1 through SF8, the first sustaining driver 27 and second sustaining driver 28, respectively, repeatedly apply sustaining pulses $IP_X$ and $IP_Y$ to each discharge cell only the number of times described hereinabove.

Furthermore, when the above mentioned illuminance signal LL is higher than illuminance L2 as shown in FIG. 22, the drive controller 22 supplies an ABL characteristic read-out signal to the ABL characteristic memory 53 for reading out a data conversion table corresponding to the ABL characteristic A. In accordance therewith, The ABL characteristic memory 53 supplies the drive controller 22 with a data conversion table corresponding to the ABL characteristic A as shown in FIG. 21. At this time, the drive controller 22 determines the number of applications of sustaining pulses corresponding to average brightness signal APL (to be applied within display period of one field) based on the above-mentioned data conversion table corresponding to the ABL characteristic A. Then, the drive controller 22 allocates the number of applications of sustaining pulses to be applied within this one field display period to the emission sustaining step Ic of each subfield as a frequency ratio as shown in FIG. 14, and supplies the timing signal for each sustaining pulse to the first sustaining driver 27 and the second sustaining driver 28, respectively. According to this operation, when the average brightness signal APL, for example, is "40" as shown in FIG. 21, according to the ABL characteristic A, "1020" will be obtained as the total number of sustaining pulses to be applied inside a one field display period. Consequently, when this pulse number for sustaining pulses of "1020" is allocated to the emission sustaining step Ic of the respective subfields SF1 through SF8 as a frequency ratio as shown in FIG. 14, as shown in FIG. 23, this frequency ratio becomes:

SF1: 4

SF2: 24

SF3: 64

SF4: 96

SF5: 140

SF6: 184

SF7: 228

SF8: 280

Accordingly, in the emission sustaining steps Ic of the respective subfields SF1 through SF8, the first sustaining driver 27 and second sustaining driver 28, respectively, repeatedly apply sustaining pulses $IP_X$ and $IP_Y$ to each discharge cell only the number of times described hereinabove.

Here, only discharge cells in which the wall charge remains unchanged, that is, discharge cells that were set to the light-emitting cell state in the above-mentioned pixel data writing step Wc, are subjected to a sustain discharge each time the above-mentioned sustaining pulses $IP_X$ and $IP_Y$ are applied, and the emission cell state accompanying this sustain discharge is maintained only for the number of discharges allocated for each subfield. Furthermore, as explained hereinabove, whether or not each discharge cell is set to the light-emitting cell state is determined by pixel driving data GD. At this time, the patterns capable of being adopted as the pixel driving data GD are the nine patterns shown in FIG. 20. Then, for all the patterns, with the exception of that for pixel driving data GD corresponding to multi-grayscale pixel data $PD_S$ "1000", which indicates the maximum brightness, only one bit within the first through the eighth bits becomes logic level "1" and all the other bits are logic level "0". Consequently, a selective erase discharge takes place only in the pixel data writing step Wc of the subfield corresponding to the bit digit of this logic level "1", and the discharge cell is set to the non-light-emitting cell state. Conversely, since a selective erase discharge does not take place in the pixel data writing step Wc of a subfield corresponding to the respective bit digits of logic level "0", the discharge cell is held in the state in which it was in up until immediately prior thereto. At this time, according to the driving shown in FIG. 14, the only step that is capable of forming a wall charge inside a discharge cell, and switching this discharge cell from the non-light-emitting cell state to the light-emitting cell state is the simultaneous resetting step Rc in the lead subfield SF1. Consequently, according to driving that makes use of the pixel driving data GD of FIG. 20, a discharge cell is held in the light-emitting cell state for the period from the head of each field until a selective erase discharge occurs in the pixel data writing step Wc of the subfields marked with a black circle in FIG. 20. Then, when a selective erase discharge occurs one time, thereafter, the discharge cell is held in a non-light-emitting cell state until the very end of one field. Accordingly, each discharge cell is held in the light-emitting cell state until the first selective erase discharge takes place inside each field, and consecutive sustain discharges occur in the emission sustaining step Ic of each subfield (indicated by white circles) that exists therebetween.

Therefore, if pixel driving data GD such as that shown in FIG. 20 is utilized, and driving, which accords with the pixel driving format shown in FIG. 14, is carried out, an intermediate brightness display of nine grayscale levels, which correspond to the total number of sustain discharge emissions that took place in each emission sustaining step Ic throughout SF1 through SF8, becomes possible.

At this time, when the illuminance around PDP 10 is relatively high, an number of applications of sustaining pulses to be applied to each discharge cell within a one field display period (SF1 through SF8) is determined based on The ABL characteristic A shown in FIG. 21. Accordingly, when the average brightness level of an input picture as shown in FIG. 21 is "40" for example, the number of applications of sustaining pulses to be applied to each discharge cell inside a one field display period constitutes "1020". Therefore, the brightness levels of the intermediate brightness of the respective nine grayscale levels achieved by emission driving patterns like the nine shown in FIG. 20 become:

{0, 4, 28, 92, 188, 328, 512, 740, 1020}

Furthermore, when the illuminance around PDP 10 is relatively high the same as described hereinabove, and the average brightness level of an input picture as shown in FIG. 21 is "50", the number of applications of sustaining pulses to be applied to each discharge cell inside a one field display period constitutes "765". Therefore, the brightness levels of the intermediate brightness of the respective nine grayscale levels achieved by emission driving patterns like the nine shown in FIG. 20 become:

{0, 3, 21, 69, 141, 246, 384, 555, 765}

That is, according to the above-mentioned ABL characteristic A, the number of applications of sustaining pulses applied to each discharge cell inside a one field display period decreases to the extent that the average brightness level of an input picture increases. In other words, for example, even if the average brightness level of an input picture increases from "40" to "50", the power limiting operation of the invention works so as to keep this consumed power within the above-mentioned first power consumption.

Conversely, when the illuminance around PDP 10 is relatively low, an number of applications of sustaining pulses to be applied to each discharge cell within a one field display period is determined based on The ABL characteristic C shown in FIG. 21. Accordingly, for example, when the average brightness level of an input picture as shown in FIG. 21 is "40", the number of applications of sustaining pulses to be applied to each discharge cell inside a one field display period constitutes "510". Therefore, the brightness levels of the intermediate brightness of the respective nine grayscale levels achieved by emission driving patterns like the nine shown in FIG. 20 become:

{0, 2, 14, 46, 94, 164, 256, 370, 510}

Therefore, the brightness of the entire screen is reduced compared to when the illuminance around PDP 10 was high as described hereinabove. That is, the present invention is constituted such that an appropriate screen brightness, which corresponds to the lightness of a place in which the plasma display apparatus is installed, is provided.

Furthermore, according to the above-mentioned ABL characteristic C, for example, even when the average brightness level of an input picture increases, the present invention is constituted such that this consumed power is kept within the above-mentioned third power consumption. At this time, the third power consumption according to this ABL characteristic C is smaller than the first power consumption according to the ABL characteristic A, which is utilized when the illuminance around PDP 10 is high. Therefore, when the illuminance around PDP 10 is low, the power consumed thereby is lower than when this illuminance is high.

In this manner, The ABL characteristics A through C can be adopted as one conversion function for determining the number of applications, that is, the application frequency of sustaining pulses to be applied inside each field, having the average brightness of an input picture and the illuminance around PDP 10 as parameters. At this time, this conversion function can be expressed by superimposing a first conversion function for converting to a sustaining pulse application frequency that makes this average brightness lower as the average brightness becomes higher, and a second conversion function for making this application frequency as small as the illuminance is low. Therefore, according to a brightness limiting operation using these ABL characteristics A through C, it becomes possible to limit the amount of power consumed to within a predetermined power consumption regardless of the brightness level of an input picture, all the while maintaining an appropriate screen brightness that tracks the illuminance around the PDP.

However, when the sustaining pulse application frequency is reduced, and the number of times sustain discharge occurs is lowered, since the priming particle weight generated in line with this discharge decreases, it becomes impossible to make the various discharges (selective erase discharge, sustain discharge) occur reliably. Accordingly, the present invention is constituted such that either the pulse width of each sustaining pulse, or the pulse widths of the scanning pulse and pixel data pulse, respectively, are widened to the extent that the sustaining pulse application frequency is reduced, thereby ensuring that the various discharges take place reliably.

Figures 24A, 24B, 24C:
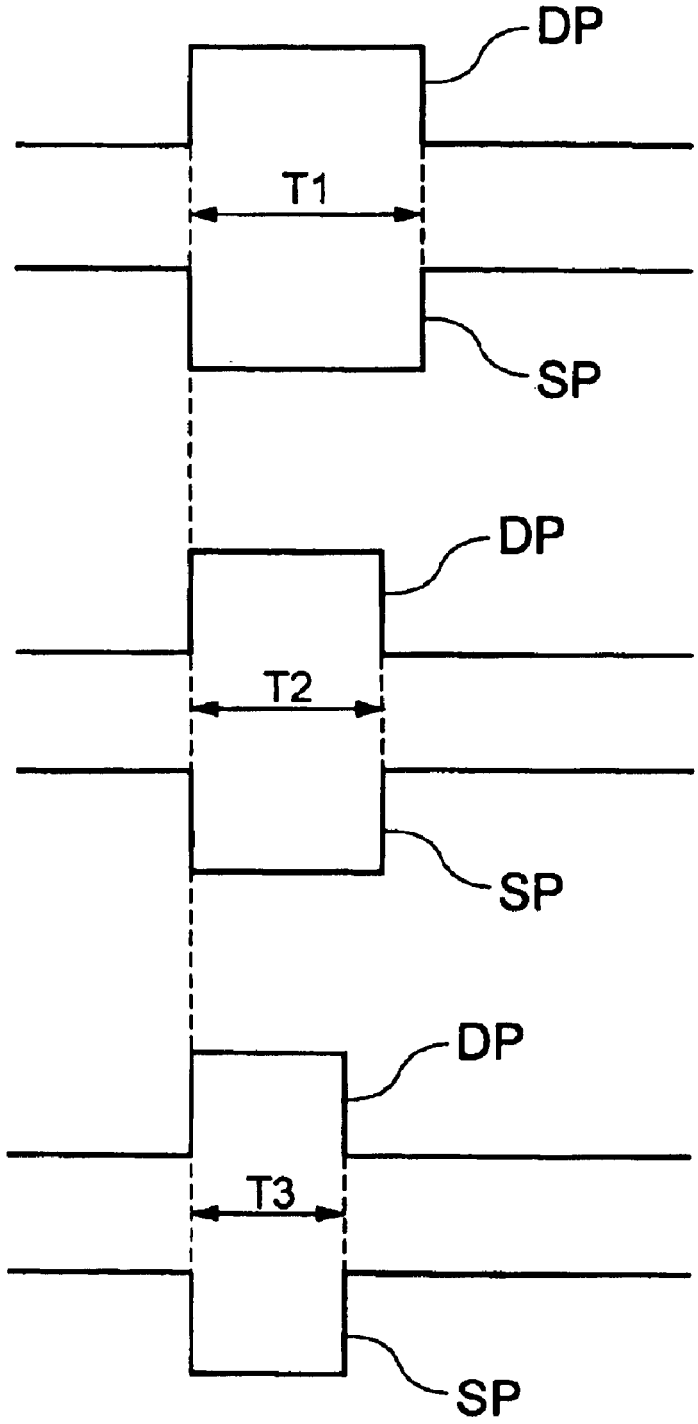
FIG. 24A through FIG. 24C are diagrams showing the pulse widths of pixel data pulses and scanning pulses SP, respectively, which change according to the number of sustaining pulses to be applied within the display period of one field.
Figure 25A:
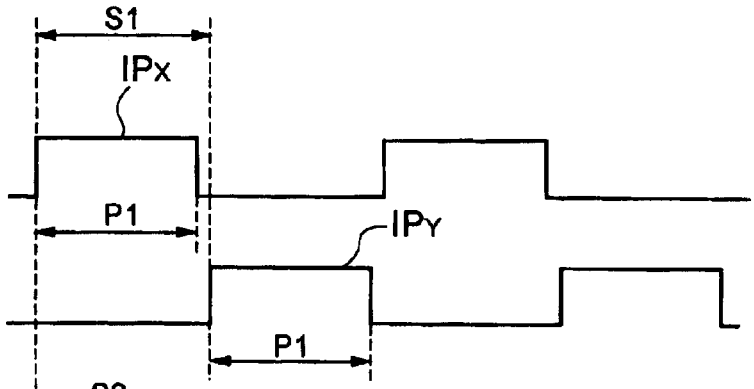
FIG. 25A through FIG. 25C are diagrams showing the pulse width of a sustaining pulse, which changes according to the number of sustaining pulses to be applied within the display period of one field.

For example, when the number of applications of sustaining pulses to be applied to discharge cells inside each field is "510", in the above-mentioned pixel data writing step Wc, the address driver 26 and second sustaining driver 28 generate a pixel data pulse and a scanning pulse SP of pulse width T1 as shown in FIG. 24A. In this process, first sustaining driver 27 and second sustaining driver 28 generate sustaining pulses $IP_X$ and $IP_P$ of pulse width P1 and synchronization S1 as shown in FIG. 25A in the above-mentioned emission sustaining step Ic.

Figure 25B:
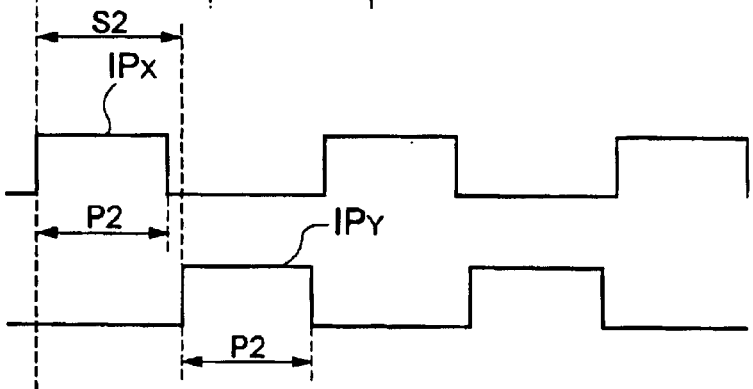

Furthermore, when the number of applications of sustaining pulses to be applied to discharge cells inside each field is "765" for example, in the above-mentioned pixel data writing step Wc, the address driver 26 and second sustaining driver 28 generate a pixel data pulse and a scanning pulse SP, which make the pulse width T2, which is narrower than the above-mentioned pulse width T1, and make the synchronization shorter than in the case of the above-mentioned pulse width T1, as shown in FIG. 24B. In this process, first sustaining driver 27 and second sustaining driver 28 generate sustaining pulses $IP_X$ and $IP_P$ of pulse width P2, which is narrower that the above-mentioned pulse width P1, and of synchronization S2, which is shorter than the above-mentioned synchronization S1, as shown in FIG. 25B in the above-mentioned emission sustaining step Ic.

Figure 25C:
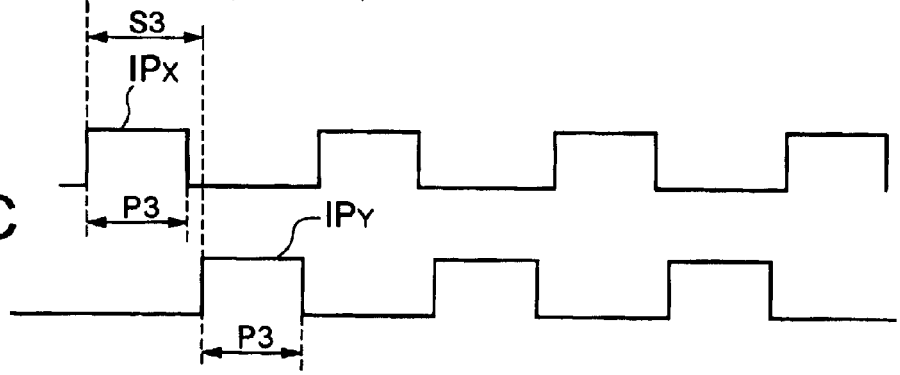

Furthermore, when the number of applications of sustaining pulses to be applied to discharge cells inside each field is "1020" for example, in the above-mentioned pixel data writing step Wc, the address driver 26 and second sustaining driver 28 generate a pixel data pulse and a scanning pulse SP, which make the pulse width T3, which is narrower than the above-mentioned pulse width T1, and make the synchronization shorter than in the case of the above-mentioned pulse width T2, as shown in FIG. 24C. In this process, first sustaining driver 27 and second sustaining driver 28 generate sustaining pulses $IP_X$ and $IP_P$ of pulse width P3, which is narrower that the above-mentioned pulse width P2, and of synchronization S3, which is shorter than the above-mentioned synchronization S2, as shown in FIG. 25C in the above-mentioned emission sustaining step Ic.

By making the pulse width of the scanning pulse, pixel data pulse and sustaining pulse as wide as the number of applications of the sustaining pulses to be applied to discharge cells inside each field is small in this way, the discharge margin for each discharge increases. In accordance therewith, it becomes possible to cause a discharge to reliably occur even, for example, when the priming particle weight that exists inside a discharge cell is small because of the small number of sustain discharges.

As explained hereinabove, in the present invention, the constitution is such that the application frequency of displaying pulses (sustaining pulses) to be applied per unit time (a one field display period) is determined based on the average brightness of an input picture and the illuminance around the PDP, and displaying pulses are applied to each discharge cell in accordance with this application frequency.

Consequently, according to the present invention, it becomes possible to limit the amount of power consumed to within a predetermined power consumption regardless of the brightness level of an input picture, all the while maintaining an appropriate screen brightness that tracks the illuminance around the plasma display panel.

This application is based on Japanese patent applications Nos. 2001-368665, 2001-375190, and 2002-9485 which are hereby incorporated by reference.

What is claimed is:

1. A plasma display panel driving device for driving, in accordance with picture signals, a plasma display panel, in which a plurality of discharge cells supporting display pixels are arranged in a matrix, comprising:

resetting means for generating a resetting pulse for causing the occurrence of a reset discharge, which initializes each of said discharge cells to one of either an light-emitting cell state or a non-light-emitting cell state, and applies the resetting pulse to each of said discharge cells;

pixel data writing means for applying to each of said discharge cells a scanning pulse for causing the occurrence of a selective discharge, which selectively sets said discharge cells to either said non-light-emitting cell state or said emission-cell state in accordance with pixel data corresponding to said picture signals;

emission sustaining means for applying to each of said discharge cells a sustaining pulse for causing the occurrence of a sustain discharge, which causes light to be emitted repeatedly only from said discharge cells that are in said light-emitting cell state;

a light sensor for detecting an ambient illuminance of said plasma display panel; and resetting pulse waveform adjusting means for adjusting the level change rate at the leading edge portion of said resetting pulse in accordance with said illuminance.

2. The plasma display panel driving device according to claim 1, wherein the level change at the leading edge portion of said resetting pulse is gentler than the level change at the leading edge portion of said scanning pulse and said sustaining pulse, respectively.

3. The plasma display panel driving device according to claim 1, wherein, when an ambient illuminance of said plasma display panel is low, said resetting pulse waveform adjusting means makes said level change rate smaller than a level change rate set when the ambient illuminance is high.

4. The plasma display panel driving device according to claim 3, wherein said adjusting means comprises means for making the number of said sustaining pulses per unit time applied to each of said discharge cells when said illuminance is low smaller than when said illuminance is high, and, in addition, for widening the pulse width of at the least one of said scanning pulse and said sustaining pulse.

5. The plasma display panel driving device according to claim 1, wherein said emission sustaining means changes the number of times that said sustaining pulse is applied to each said discharge cell in accordance with an ambient illuminance of said plasma display panel.

6. The plasma display panel driving device according to claim 5, wherein, when the ambient illuminance of said plasma display panel is low, said emission sustaining means makes the number of times that said sustaining pulse is applied to each said discharge cell smaller than when the ambient illuminance is high.

7. A plasma display panel driving device for driving, in accordance with picture signals, a plasma display panel, in which a plurality of discharge cells supporting display pixels are arranged in a matrix, having:

resetting means for generating a resetting pulse for causing the occurrence of a reset discharge, which initializes each of said discharge cells to one of either an light-emitting cell state or a non-light-emitting cell state, and applies the resetting pulse to each of said discharge cells;

pixel data writing means for applying to each of said discharge cells a scanning pulse for causing the occurrence of a selective discharge, which selectively sets said discharge cells to either said non-light-emitting cell state or said emission-cell state in accordance with pixel data corresponding to said picture signals;

emission sustaining means for applying to each of said discharge cells a sustaining pulse for causing the occurrence of a sustain discharge, which causes light to be emitted repeatedly only from said discharge cells that are in said light-emitting cell state; and a light sensor for detecting an ambient illuminance of said plasma display panel, wherein said resetting means changes the number of times that said resetting pulse is applied to each of said discharge cells in accordance with said illuminance.

8. The plasma display panel driving device according to claim 7, wherein, when the ambient illuminance of said plasma display panel is low, said resetting means makes the number of times that said resetting pulse is applied to each said discharge cell smaller than when the ambient illuminance is high.

* * * * *